US009370049B2

(12) United States Patent
Fishman et al.

(10) Patent No.: US 9,370,049 B2
(45) Date of Patent: Jun. 14, 2016

(54) ELECTRIC INDUCTION HEATING, MELTING AND STIRRING OF MATERIALS NON-ELECTRICALLY CONDUCTIVE IN THE SOLID STATE

(75) Inventors: Oleg S. Fishman, Maple Glen, PA (US); John H. Mortimer, Little Egg Harbor Township, NJ (US); Satyen N. Prabhu, Voorhees, NJ (US); Mike Maochang Cao, Westampton, NJ (US)

(73) Assignee: INDUCTOTHERM CORP., Rancocas, NJ (US)

( * ) Notice: Subject to any disclaimer, the term of this patent is extended or adjusted under 35 U.S.C. 154(b) by 1884 days.

(21) Appl. No.: 11/942,341

(22) Filed: Nov. 19, 2007

(65) Prior Publication Data

US 2008/0063025 A1 Mar. 13, 2008

Related U.S. Application Data

(63) Continuation-in-part of application No. 11/297,010, filed on Dec. 8, 2005, now Pat. No. 7,457,344.

(60) Provisional application No. 60/634,353, filed on Dec. 8, 2004.

(51) Int. Cl.

| | |
|---|---|
| ***H05B 6/44*** | (2006.01) |
| ***H05B 6/06*** | (2006.01) |
| ***H05B 6/22*** | (2006.01) |

(52) U.S. Cl.

CPC ..... *H05B 6/067* (2013.01); *H05B 2213/02* (2013.01)

(58) Field of Classification Search

CPC ..... H05B 6/067; H05B 6/32; H05B 6/367; H05B 6/44; H05B 6/34; H05B 6/24; H05B 2213/02; F27B 14/061; F27B 14/14; F27B 14/00; F27B 14/10

USPC ..... 373/144, 150, 151, 138, 139, 145–149, 373/152, 154, 7; 219/620, 626, 625, 627, 219/650, 635, 638, 634; 75/10.14, 10.15

See application file for complete search history.

(56) References Cited

U.S. PATENT DOCUMENTS

| | | | |
|---|---|---|---|
| 1,852,215 | A | 4/1932 | Northrup |
| 1,943,802 | A | 1/1934 | Northrup |

(Continued)

FOREIGN PATENT DOCUMENTS

| | | | |
|---|---|---|---|
| DE | 1800431 | A1 | 1/1971 |
| FR | 713498 | A | 10/1931 |

(Continued)

OTHER PUBLICATIONS

W.R. Runyan; Silicon Semiconductor Technology; 1965; pp. 38-39; McGraw-Hill Book Company, New York.

(Continued)

*Primary Examiner* — Hung D Nguyen

(74) *Attorney, Agent, or Firm* — Philip O. Post

(57) ABSTRACT

An apparatus and process are provided for controlling the heating and melting of a material that is non-electrically conductive in the solid state and is electrically conductive in the non-solid state. Power is selectively directed between coil sections surrounding different zones of the material in a susceptor vessel by changing the output frequency of the power supply to the coil sections. Coil sections are at least one active coil section, which is connected to the output of the power supply, and at least one passive coil section, which is not connected to the power supply, but is connected in parallel with a tuning capacitor so that the at least one passive coil section can be selectively operated at, or near, resonant frequency when the transition material in the vessel is molten. Depending upon the state of the transition material in the susceptor vessel, the frequency of the power applied to the active coil section can be changed to generate a magnetic field that selectively couples with the susceptor vessel, transition material in the vessel, and/or the passive coil section.

19 Claims, 20 Drawing Sheets

(56) References Cited

U.S. PATENT DOCUMENTS

| | | | | |
|---|---|---|---|---|
| 2,793,242 | A | 5/1957 | Beckius et al. | |
| 3,442,622 | A * | 5/1969 | Monnier et al. | 423/348 |
| 3,478,156 | A | 11/1969 | Segsworth | |
| 4,207,293 | A * | 6/1980 | Scholl et al. | 117/202 |
| 4,242,553 | A | 12/1980 | Berkman et al. | |
| 4,471,488 | A | 9/1984 | Reboux | |
| 5,260,538 | A | 11/1993 | Clary et al. | |
| 6,121,592 | A * | 9/2000 | Fishman et al. | 219/661 |
| 6,361,597 | B1 | 3/2002 | Takase et al. | |
| 6,542,535 | B2 | 4/2003 | Fishman et al. | |
| 6,696,770 | B2 | 2/2004 | Nadot et al. | |
| 6,798,822 | B2 * | 9/2004 | Fishman et al. | 373/146 |
| 6,992,406 | B2 | 1/2006 | Fishman et al. | |
| 7,110,430 | B2 | 9/2006 | Lazor | |
| 7,197,061 | B1 | 3/2007 | Fishman et al. | |
| 2002/0053973 | A1 * | 5/2002 | Ward, Jr. | 340/506 |
| 2003/0035309 | A1 * | 2/2003 | Nadot et al. | 363/37 |
| 2004/0256383 | A1 | 12/2004 | Fischer et al. | |
| 2005/0259712 | A1 * | 11/2005 | Lazor | 373/144 |
| 2006/0050763 | A1 | 3/2006 | Lazor et al. | |
| 2006/0118549 | A1 | 6/2006 | Fishman et al. | |
| 2007/0009005 | A1 | 1/2007 | Lazor | |

FOREIGN PATENT DOCUMENTS

| | | | |
|---|---|---|---|
| GB | 371553 | A | 4/1932 |
| WO | 02/054831 | A2 | 7/2002 |
| WO | 2004/004420 | A1 | 1/2004 |

OTHER PUBLICATIONS

T.F. Ciszek, G.H. Schwuttke, and K.H. Yang; Solar-Grade Silicon by Directional Solidification in Carbon Crucibles; IBM Journal of Research and Development; May 1979; pp. 270-277; vol. 23, No. 3; IBM Corporation; Amonk, NY.

Sindanyo Furnace (with Crucible); 1981; (3 pages total); Inductotherm Europe LTD.

Induction Susceptor Furnaces; Tech Application; 1988; (1 page total); vol. 2, No. 2; Electric Power Research Institute Center for Material Fabrications; Palo Alto, CA.

* cited by examiner

– –PRIMARY SECTION POWER
· · ·SECONDARY SECTION POWER
—TOTAL COIL POWER 40
48
42
46
90a
44b
44a
C'TUNE
3
20'
4

Rtm (hot upper)
Ihot (upper)
L44b
C'TUNE
M
L44a
Rsv
Rtm (hot lower)
Ihot (lower)

Rtm (hot upper)
Rtm (hot lower)
Rsv
Ihot (lower)
FL'44a
[Rtm (hot upper)]=[Rtm (hot lower)]·[M2/(L44a·L44a)]

ELECTRIC INDUCTION HEATING, MELTING AND STIRRING OF MATERIALS NON-ELECTRICALLY CONDUCTIVE IN THE SOLID STATE

CROSS REFERENCE TO RELATED APPLICATIONS

This application is a continuation-in-part of U.S. application Ser. No. 11/297,010 filed Dec. 8, 2005, which claims the benefit of U.S. Provisional Application No. 60/634,353, filed Dec. 8, 2004, both of which are incorporated herein by reference in their entireties.

FIELD OF THE INVENTION

The present invention relates to control of electric induction heating, melting and stirring of a material wherein zone heating or melting is selectively controlled and the material is non-electrically conductive in the solid state and electrically conductive in the non-solid state.

BACKGROUND OF THE INVENTION

Batch electric induction heating and melting of an electrical conductive material can be accomplished in a crucible by surrounding the crucible with an induction coil. A batch of an electrically conductively material, such as metal ingots or scrap, is placed in the crucible. One or more induction coils surround the crucible. A suitable power supply provides ac current to the coils, thereby generating a magnetic field around the coils. The field is directed inward so that it magnetically couples with the material in the crucible, which induces eddy current in the material. Basically the magnetically coupled circuit is commonly described as a transformer circuit wherein the one or more induction coils represent the primary winding, and the magnetically coupled material in the crucible represents a shorted secondary winding.

FIG. 1 illustrates in simplified form one example of a circuit comprising a power supply, load impedance matching element (tank capacitor $C_T$), and induction coil $L_L$ that can be used in a batch melting process. The power supply 102 comprises ac to dc rectifier 104 and inverter 106. Rectifier 104 rectifies available ac power (AC MAINS) into dc power. Typically after filtering of the dc power, inverter 106, utilizing suitable semiconductor switching components, outputs single-phase ac power. The ac power feeds the load circuit, which comprises the impedance of the induction coil and the impedance of the electromagnetically coupled material in the crucible, as reflected back into the primary load circuit. The value of tank capacitor $C_T$ is selected to maximize power transfer to the primarily inductive load circuit. Induction coil $L_L$ comprises primary section $L_P$ and secondary section $L_S$, which are preferably connected in a counter-wound parallel configuration to establish instantaneous current flow through the coil as indicated by the arrows in FIG. 1.

FIG. 2(*a*) illustrates the use of the arrangement in FIG. 1 with crucible 110 to batch melt generally solid metal composition 112 (diagrammatically shown as discrete circles) that is placed in the crucible. The state of the batch melting process in FIG. 2(*a*) is referred to as the "cold state" since generally none of the metal composition is melted. Load impedance for the upper (primary) coil load circuit is substantially equal to the load impedance for the lower (secondary) coil load circuit. As the metal composition is inductively heated, molten material forms at the bottom of the crucible while solid material is generally added to the upper section of the crucible. FIG. 2(*b*) illustrates the "warm state" of the batch melting process wherein the lower half of the crucible generally contains molten material (diagrammatically shown as lines) and the upper half of the crucible generally contains solid material. In the warm state the load impedance of the lower coil load circuit is lower than the load impedance of the upper coil load primarily since the equivalent load resistance of the molten material is lower than the equivalent load resistance of the solid material. Finally in FIG. 2(*c*), which illustrates the "hot state" of the batch melting process, generally all of the material in the crucible is in the molten state, and the load impedances in the upper and lower coil load circuits are equal, but lower in magnitude than the load impedances in the cold state.

FIG. 3(*a*), FIG. 3(*b*) and FIG. 3(*c*) graphically illustrate the division of power supplied from the power supply in the upper (primary section $\mathbf{c1}_i$ in these figures) and lower (secondary section $\mathbf{c2}_i$ in these figures) coil sections for the total coil ($c_i$ in these figures) shown in FIG. 1 and FIG. 2(*a*) through FIG. 2(*c*) as the batch melting process proceeds through the cold, warm and hot stages, respectively. For example: in the cold state (FIG. 3(*a*) with power supply output at 600 kW and approximately 390 Hertz), approximately 300 kW is supplied to the upper coil section and 300 kW is supplied to the lower coil section; in the warm state (FIG. 3(*b*) with power supply output at 600 kW and approximately 365 Hertz), approximately 200 kW is supplied to the upper coil section and 400 kW is supplied to the lower coil section; and in the hot state (FIG. 3(*c*) with power supply output at 600 kW and approximately 370 Hertz), approximately 300 kW is supplied to the upper coil section and 300 kW is supplied to the lower coil section. This example illustrates the general process condition that as the batch melting proceeds from the cold state to the warm state, more power is provided to the lower coil section than to the upper coil section since the lower coil section surrounds an increasing amount of molten material, which has a lower resistance than the solid material, as the process progresses until the height of the molten material is sufficient to magnetically couple with the field generated by the upper coil section. This condition is opposite to the preferred condition, namely that the solid material should receive more power than the molten material to quicken melting of the entire batch of metal. The solid line in FIG. 4 graphically illustrates the typical efficiency of a batch melting process over the time of the process while the dashed line illustrates a typical 82 percent average efficiency for the process.

Similarly when the primary and secondary coil sections surround a susceptor or an electrically conductive material, such as a billet or metal slab, the arrangement in FIG. 1 and FIG. 2(*a*) through FIG. 2(*c*), with the susceptor or electrically conductive material replacing crucible 110 containing solid metal composition 112, results in a non-controlled temperature pattern along the length of the material due to the fact that the energy delivery pattern is defined by the coil arrangement and the energy consumption pattern is defined by the processes inside a susceptor, or the heat absorption characteristics of the billet material.

There is a class of materials, such as silicon, that are substantially non-electrically conductive in the "cold" or solid (crystalline) state and electrically conductive in the non-solid (semi-solid, liquid or molten) state. For example the resistivity of crystalline silicon is over 100,000 μohm·cm below its nominal melting temperature of 1,410° C., and typically 75-80 μohm·cm in the molten state. This class of materials is referred to herein as transition materials. Typically a transition material is heated to the molten state to reshape the material or separate impurities from the material. Electric induction power directly heats an electrically conductive material by inducing eddy currents in the material as described above and in FIG. 1 and FIG. 2(*a*) through FIG. 2(*c*). If the material is non-electrically conductive, then an indirect induction heating method must be used to heat the material. For example electric induction power can be used to electromagnetically heat a discrete susceptor, with heat from the susceptor being transferred to the transition material by conduction, and then by convection through the transition material.

There are two general approaches to heating and melting a transition material with electric induction power. In the first general approach, "cold" or solid and substantially non-electrically conductive transition material, for example, in the form of pellets, are placed in a non-electrically conductive refractory crucible surrounded by an induction coil. Since flux from the magnetic field generated by the flow of ac current in the coil can not inductively heat the solid transition material, one or more discrete susceptors can either be permanently installed in areas around the non-electrically conductive crucible, or temporally brought close to, or in contact with, the solid transition material in the non-electrically conductive crucible. The magnetic flux will electromagnetically heat (suscept) the discrete susceptors due to their high susceptance, and, in turn, the susceptors will transfer heat by conduction to the solid transition material in the non-electrically conductive crucible. Permanently installed discrete susceptors are disadvantageous in that after the solid transition material begins to melt and becomes electrically conductive, magnetic flux continues to be at least partially coupled with the permanently installed discrete susceptors, which decreases the efficiency of the heating and melting process. Further depending upon where the one or more discrete susceptors are permanently located, relative to other components of the crucible system, dissipation of electromagnetically generated heat in the discrete susceptor can degrade adjacent components of the crucible system. For example an electromagnetically heated discrete susceptor located adjacent to a crucible's interior liner material that prevents contamination of transition material in the crucible with refractory material may overheat and degrade the liner while heat is transferred by conduction from the susceptor to the transition material in the crucible. Temporarily installed discrete susceptors are disadvantageous in that apparatus is required for moving the susceptors. The requirement for susceptors can be eliminated by depositing transition material in the solid state into a refractory crucible that is at least partially filled with molten transition material. The solid material must be quickly dissolved in the molten bath while electromagnetic induction current suscepts to the molten material and provides necessary heat for melting.

In the second general approach, the solid transition material can be placed in a susceptor vessel that is surrounded by an induction coil. The flow of ac current in the induction coil will generate a magnetic field that electromagnetically couples with the susceptor vessel to heat the vessel. The heated susceptor vessel will heat transition material placed in the vessel by conduction regardless of the state of electrical conductivity of the material. The degree to which the magnetic flux from the field will couple with the susceptor vessel and electrically conductive transition material in the susceptor vessel is fundamentally dependent upon the electrical frequency of ac current supplied to the induction coil and the wall thickness of the susceptor vessel. The standard depth of penetration (Δ, in meters) of ac current into a material as a function of frequency is defined by the equation:

$$\Delta = 503 \cdot \sqrt{\frac{\rho}{f \cdot \mu}}, \qquad \text{[equation (1)]}$$

where ρ is the resistivity of the material comprising the susceptor vessel in ohm·meters;

f is the frequency of the ac current supplied to the induction coil in Hertz; and μ is the magnetic permeability (dimensionless relative value) of the material comprising the susceptor vessel.

If the standard depth of penetration is less than the thickness of the susceptor vessel, then most input electrical energy is used to electromagnetically heat the susceptor vessel, which then transfers heat to the transition material in the vessel by conduction. Conversely if the standard depth of penetration is substantially greater than the thickness of the susceptor vessel, then most input electrical energy is used to inductively heat transition material in the vessel after it transitions to the non-solid state.

Therefore there is the need for selectively inducing heat to a susceptor vessel and a transition material contained in the vessel when the inductive heating and melting process utilizes multiple coil sections.

It is one object of the present invention to provide apparatus for, and method of, batch heating and melting of a transition material with electric induction power in a susceptor vessel surrounded by multiple coil sections without the disadvantages of a refractory crucible in combination with discrete susceptors located either permanently or temporarily around, or in, the refractory crucible while optimizing the transfer of induced power to transition material in the susceptor vessel when the transition material is in the electrically conductive state.

It is another object of the present invention to electromagnetically induce a stirring pattern in the transition material in the susceptor vessel when substantially all transition material is in the electrically conductive molten state to achieve rapid dissolution of any solid transition material that may be added to the molten transition material in the susceptor vessel.

BRIEF SUMMARY OF THE INVENTION

In one aspect the present invention is apparatus for, and method of, heating and melting a transition material that is substantially non-electrically conductive in the solid (cold) state and electrically conductive in the non-solid (warm or hot) state. For example, silicon is a transition material that is substantially non-electrically conductive until it reaches a nominal melting temperature of 1,410° C. The term "solid" as used herein means any physical form of the transition material, including, for example, a solid cylinder, pellets or powder of the transition material.

The transition material can be placed in a susceptor vessel in the solid state. A primary or active induction coil surrounds a lower section of the susceptor vessel and is connected to an ac power supply. A secondary or passive induction coil surrounds a section of the susceptor vessel above the lower section and is connected to a tuning capacitor to form a passive circuit that is at, or near, resonance when the transition material in the region of the susceptor vessel surrounded by the passive induction coil is in the molten (hot) state and the output of the ac power supply is set at a hot state operating frequency so that current flowing in the active induction coil generates a magnetic field that induces significant current flow in the passive circuit when the load circuit is at, or near, resonance as further described below.

Power supply frequency control is provided so that initially, in the cold state, when substantially all of the transition material in the susceptor vessel is non-electrically conductive, the output frequency is set to a cold state operating frequency that limits inductive heating to the lower section of the susceptor vessel and, optionally, for a small distance into the vessel to inductively heat transition material adjacent to the inner wall of the vessel as that transition material is heated by conduction from the inductively heated wall of the susceptor vessel.

As more of the transition material in the susceptor vessel melts and becomes electrically conductive, the frequency controller reduces the output frequency of the power supply to a warm state operating frequency to provide increased electromagnetic coupling with the melting transition material in the vessel until the power supply's load resistance begins to increase due to effective magnetic coupling between the active and passive induction coils when the output frequency of the power supply increases to the hot state operating frequency, which is the resonant, or near resonant, frequency of the passive circuit.

Other aspects of the invention are set forth in this specification and the appended claims.

BRIEF DESCRIPTION OF THE DRAWINGS

The foregoing brief summary, as well as the following detailed description of the invention, is better understood when read in conjunction with the appended drawings. For the purpose of illustrating the invention, there is shown in the drawings exemplary forms of the invention that are presently preferred; however, the invention is not limited to the specific arrangements and instrumentalities disclosed in the following appended drawings:

FIG. 2(*b*) illustrates a prior art heating and melting process in a warm state wherein approximately half of the electrically conductive material is melted.

FIG. 2(*c*) illustrates a prior art heating and melting process in a hot state wherein substantially all of the electrically conductive material is melted.

FIG. 3(*b*) graphically illustrates power division between upper and lower induction coil sections for the prior art heating and melting warm state shown in FIG. 2(*b*) as a function of the frequency of the applied heating power.

FIG. 3(*c*) graphically illustrates power division between upper and lower induction coil sections for the prior art heating and melting hot state shown in FIG. 2(*c*) as a function of the frequency of the applied heating power.

FIG. 6(*b*) graphically illustrates magnitudes of the currents in the active and passive load coils in the cold state for one example of the electric induction control system of the present invention.

FIG. 6(*c*) graphically illustrates the change in phase shift between currents in the active and passive coils with the change in frequency of the heating power in the cold state for one example of the electric induction control system of the present invention.

FIG. 7(*b*) graphically illustrates magnitudes of currents in the active and passive load coils in the warm state for one example of the electric induction control system of the present invention.

FIG. 7(*c*) graphically illustrates the change in phase shift between currents in the active and passive coils with the change in frequency of the heating power in the warm state for one example of the electric induction control system of the present invention.

FIG. 8(*b*) graphically illustrates magnitudes of currents in the active and passive load coils in the hot state for one example of the electric induction control system of the present invention.

FIG. 8(*c*) graphically illustrates the change in phase shift between currents in the active and passive coils with the change in frequency of the heating power in the hot state for one example of the electric induction melt control system of the present invention.

FIG. 11(*b*) illustrate electromagnetic flow patterns for molten material in a crucible with the electric induction control system of the present invention when the electrical phases between the active and passive load circuit currents are approximately less than 20 electrical degrees.

FIG. 15(*b*) is a simplified schematic load circuit for the heating and melting system shown in FIG. 15(*a*).

FIG. 15(*c*) is a simplified schematic load circuit for the heating and melting system when the system is in the warm state and the volume of transition material in the susceptor vessel has been partially melted to the electrically conductive state.

FIG. 16(*b*) is a simplified schematic load circuit for the heating and melting system when operating in the hot state with substantially all transition material in the electrically conductive state and the passive coil circuit is at resonance with effective magnetic coupling between the active and passive coil circuits.

FIG. 16(*c*) represents the load circuit in FIG. 16(*b*) in an equivalent form that illustrates the increased equivalent load resistance when effective magnetic coupling is achieved between the active and passive coil circuits.

FIG. 19(*b*) graphically illustrates the change in induced power relative to operating frequency for one example of the heating and melting system of the present invention as the transition material in the susceptor vessel progresses through the cold, warm and hot states.

DETAILED DESCRIPTION OF THE INVENTION

Figure 5:
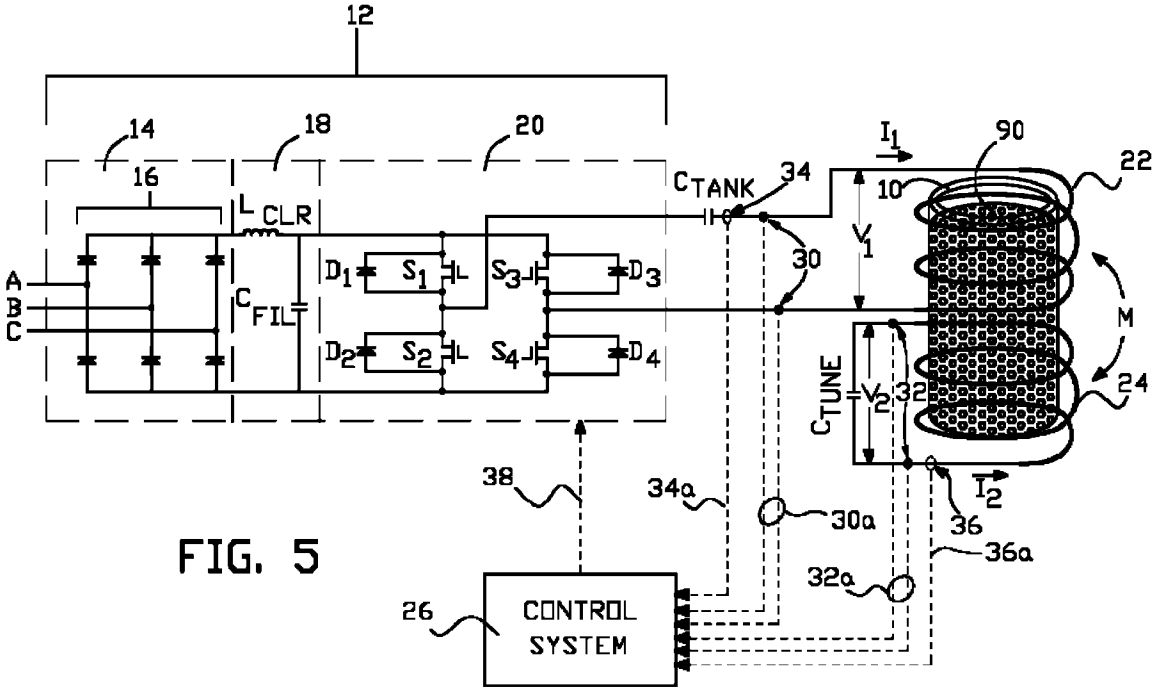
FIG. 5 illustrates in simplified schematic and diagrammatic form one example of the electric induction control system of the present invention.

Referring now to the drawings, wherein like numerals indicate like elements, there is shown in FIG. 5, one example of a simplified electrical diagram of the electric induction control system of the present invention.

U.S. Pat. No. 6,542,535, the entirety of which is incorporated herein by reference, discloses an induction coil comprising an active coil that is connected to the output of an ac power supply, and a passive coil connected with a capacitor to form a closed circuit that is not connected to the power supply. The active and passive coils surround a crucible in which an electrically conductive material is placed. The active and passive coils are arranged so that the active magnetic field generated by current flow in the active coil, which current is supplied from the power supply, magnetically couples with the passive coil, as well as with the material in the crucible.

FIG. 5 illustrates one example of an ac power supply 12 utilized with the electric induction control system of the present invention. Rectifier section 14 comprises a full wave bridge rectifier 16 with ac power input on lines A, B and C. Optional filter section 18 comprises current limiting reactor $L_{CLR}$ and dc filter capacitor $C_{FIL}$. Inverter section 20 comprises four switching devices, $S_1$, $S_2$, $S_3$ and $S_4$, and associated anti-parallel diodes $D_1$, $D_2$, $D_3$ and $D_4$, respectively. Preferably each switching device is a solid state device that can be turned on and off at any time in an ac cycle, such as an insulated gate bipolar transistor (IGBT).

The non-limiting example load circuit comprises active induction coil 22, which is connected to the inverter output of the power supply via load matching (or tank) capacitor $C_{TANK}$, and passive induction coil 24, which is connected in parallel with tuning capacitor $C_{TUNE}$ to form a passive load circuit. Current supplied from the power supply generates a magnetic field around the active induction coil. This field magnetically couples with electrically conductive material 90 in crucible 10 and with the passive induction coil, which induces a current in the passive load circuit. The induced current flowing in the passive induction coil generates a second magnetic field that couples with the electrically conductive material in the crucible. Voltage sensing means 30 and 32 are provided to sense the instantaneous voltage across the active coil and passive coils respectively; and control lines 30*a* and 32*a* transmit the two sensed voltages to control system 26. Current sensing means 34 and 36 are provided to sense the instantaneous current through the active coil and passive coil, respectively; and control lines 34*a* and 36*a* transmit the two sensed currents to control system 26. Control system 26 includes a processor to calculate the instantaneous power in the active load circuit and the passive load circuit from the inputted voltages and currents. The calculated values of power can be compared by the processor with stored data for a desired batch melting process power profile to determine whether the calculated values of power division between the active and passive load circuits are different from the desired batch melting process power profile. If there is a difference, control system 26 will output gate turn on and turn off signals to the switching devices in the inverter via control line 38 so that the output frequency of the inverter is adjusted to achieve the desired power division between the active and passive load circuits.

Figure 6A:
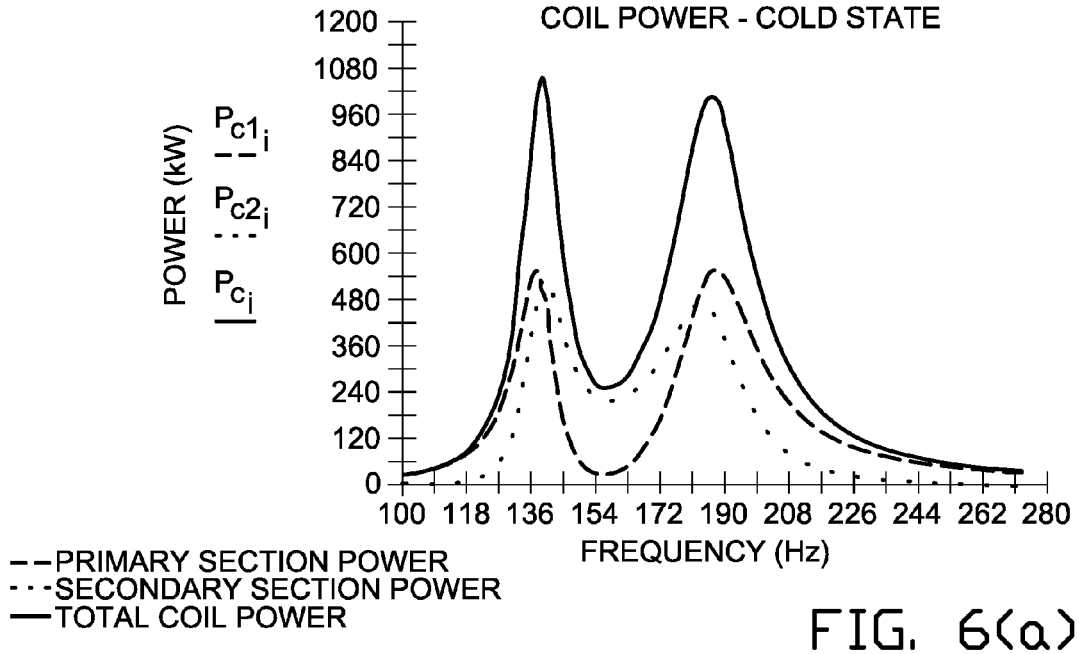
FIG. 6(*a*) graphically illustrates power division between the active induction coil and the passive induction coil in the cold state for one example of the electric induction control system of the present invention as the frequency of the heating power is varied.
Figure 6B:
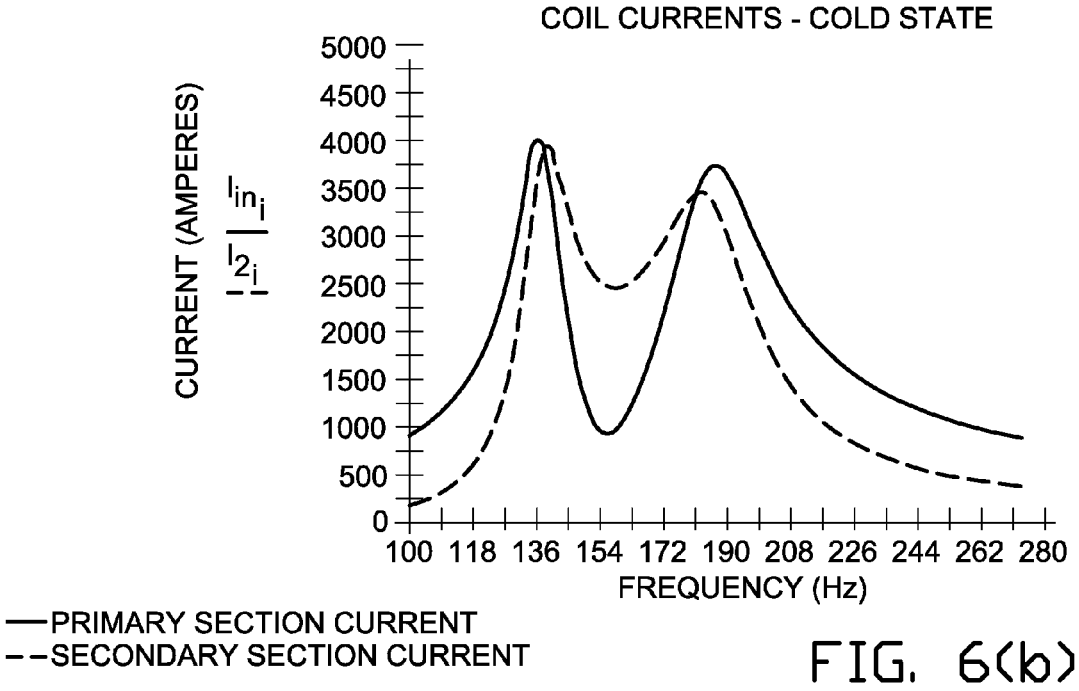
Figure 6C:
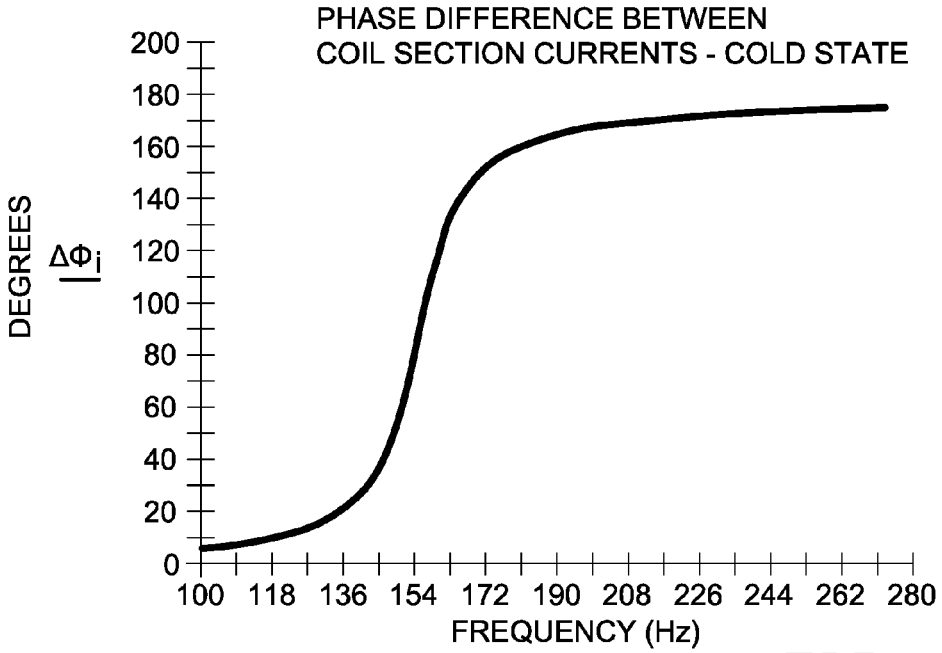

By selecting tank capacitor $C_{TANK}$, tuning capacitor $C_{TUNE}$, and active and passive induction coils of appropriate values, the active load circuit will have a resonant frequency that is different from that of the passive load circuit. FIG. 6(*a*), FIG. 7(*a*) and FIG. 8(*a*) illustrate one example of the power division achieved in active and passive induction coils over a frequency range for one set of circuit values. For example: in the cold state (FIG. 6(*a*) with power supply output at 1,000 kW and approximately 138 Hertz), approximately 500 kW is supplied to the active coil section and 500 kW is supplied to the passive coil section; in the warm state (FIG. 7(*a*) with power supply output at 1,000 kW and approximately 136 Hertz), approximately 825 kW is supplied to the active coil section and 175 kW is supplied to the passive coil section; and in the hot state (FIG. 8(*a*) with power supply output at 1,000 kW and approximately 134 Hertz), approximately 500 kW is supplied to the active coil section and approximately 500 kW is supplied to the passive coil section. Unlike the prior art, in the intermediate states between the cold and hot state, more power can be directed to the upper (active) coil, which surrounds substantially solid material in the crucible for the approximately first half of the batch melting process in this example, than to the lower (passive) coil, which surrounds an increasing level of molten material for the approximately first half of the batch melting process in this example. This condition is exemplified by the power division in the warm state wherein the induction heating control system of the present example directs most of the power to the upper coil to melt the substantially solid material surround by the upper coil.

The stored data for a desired batch melting process for a particular circuit and crucible arrangement may be determined from the physical and electrical characteristics of the particular arrangement. Power and current characteristics versus frequency for the active and passive load circuits in a particular arrangement may also be determined from the physical and electrical characteristics of a particular arrangement.

In alternative examples of the invention different parameters and methods may be used to measure power in the active and passive load circuits as known in the art. The processor in control system 26 may be a microprocessor or any other suitable processing device. In other examples of the invention different numbers of active and passive induction coils may be used; the coils may also be configured differently around the crucible. For example active and passive coils may be overlapped, interspaced or counter-wound to each other to achieve a controlled application of induced power to selected regions of the electrically conductive material.

Figure 7A:
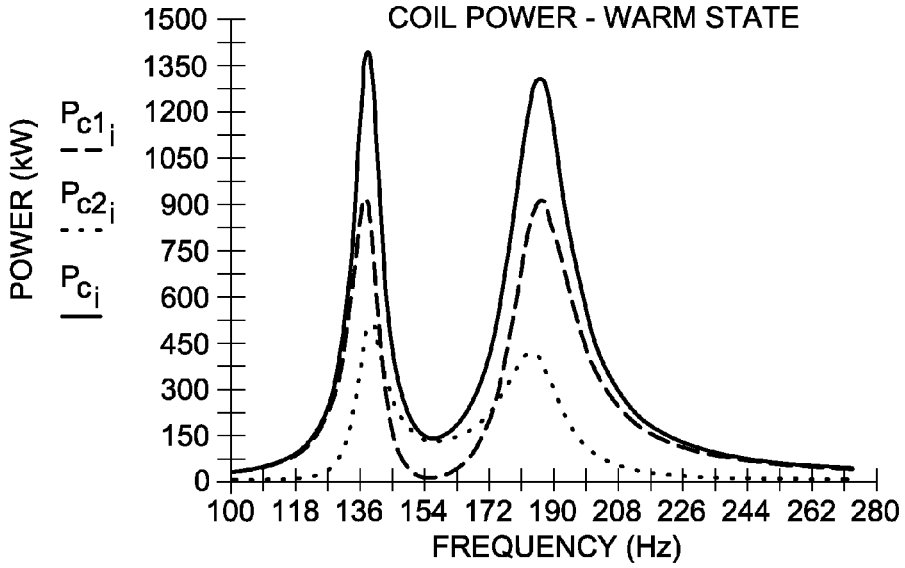
FIG. 7(*a*) graphically illustrates power division between the active induction coil and the passive induction coil in the warm state for one example of the electric induction control system of the present invention as the frequency of the heating power is varied.
Figure 7B:
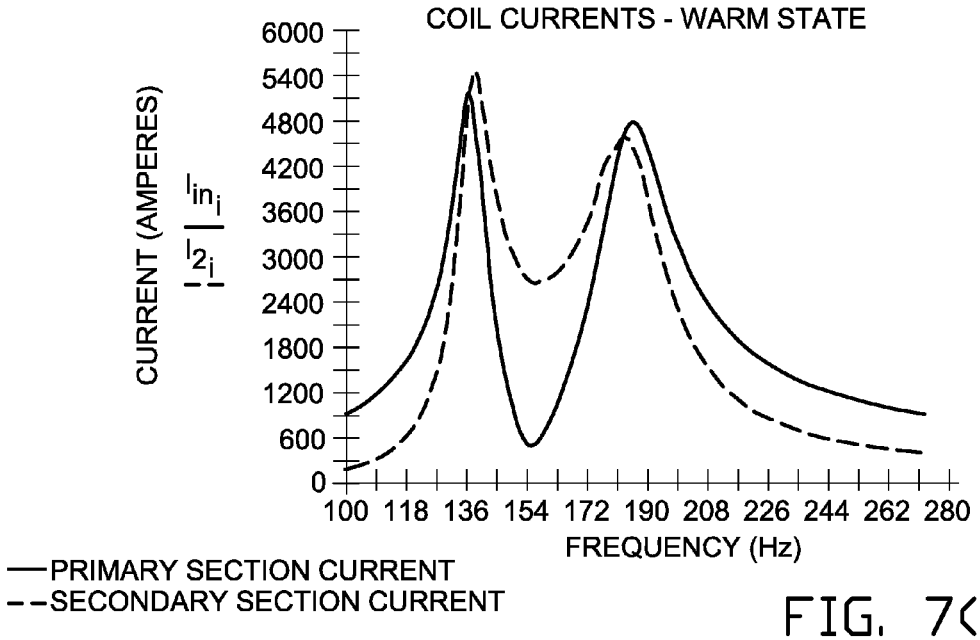
Figure 7C:
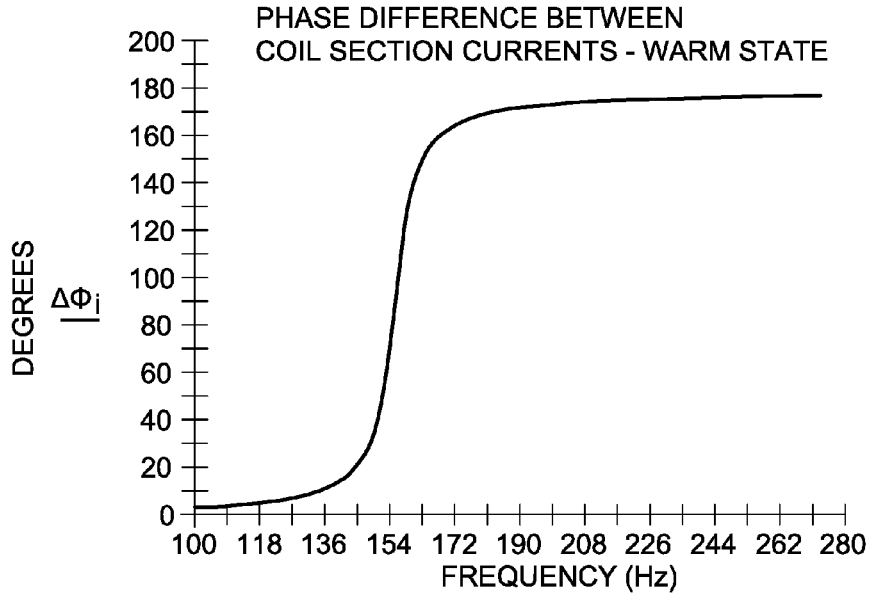
Figure 8A:
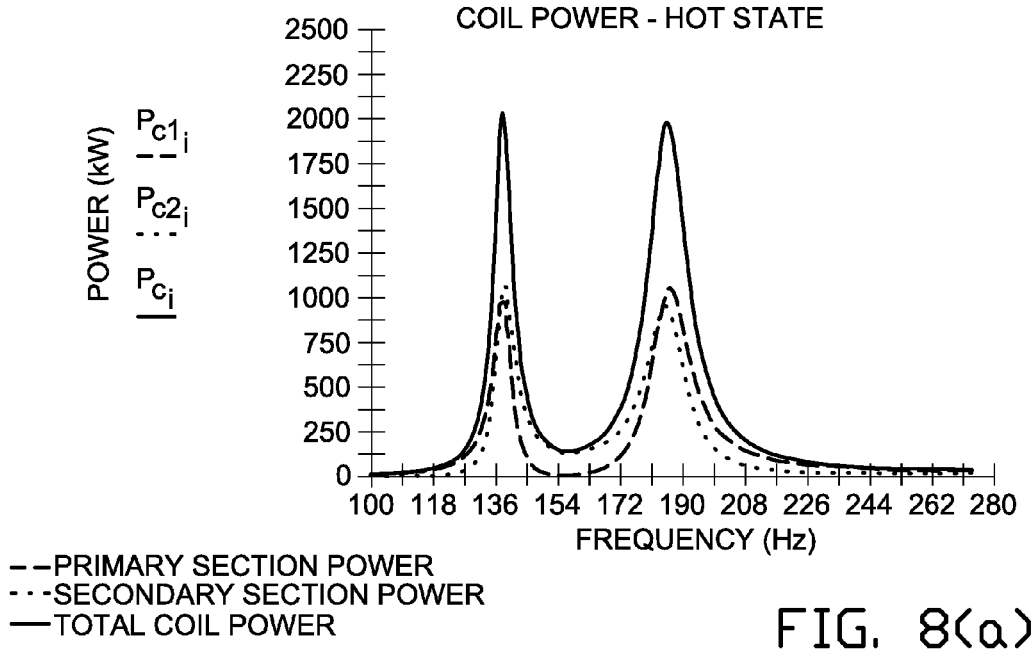
FIG. 8(*a*) graphically illustrates power division between the active induction coil and the passive induction coil in the hot state for one example of the electric induction control system of the present invention as the frequency of the heating power is varied.
Figure 8B:
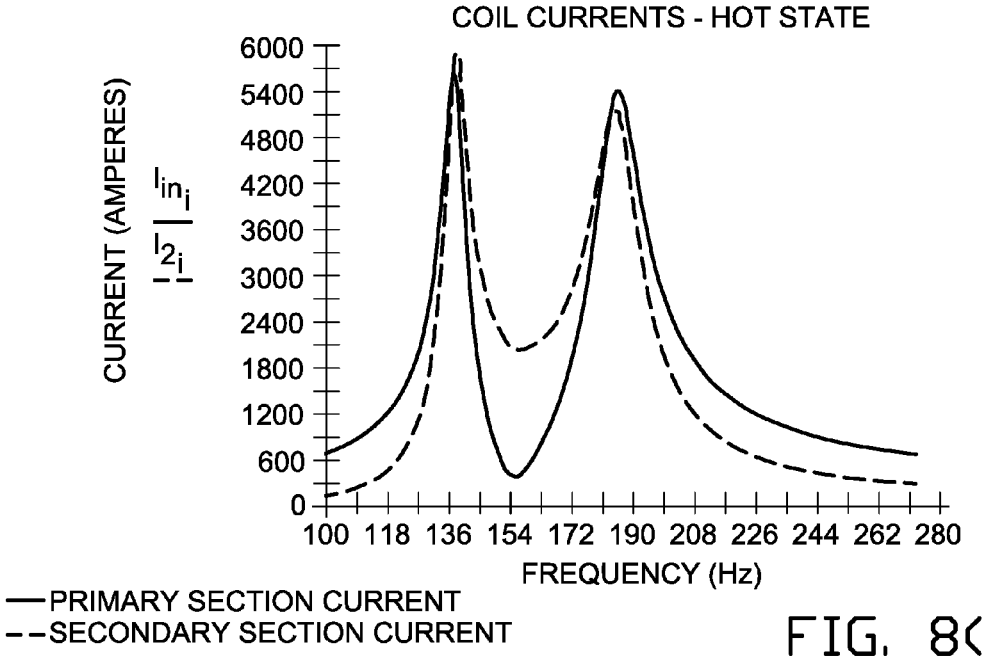
Figure 8C:
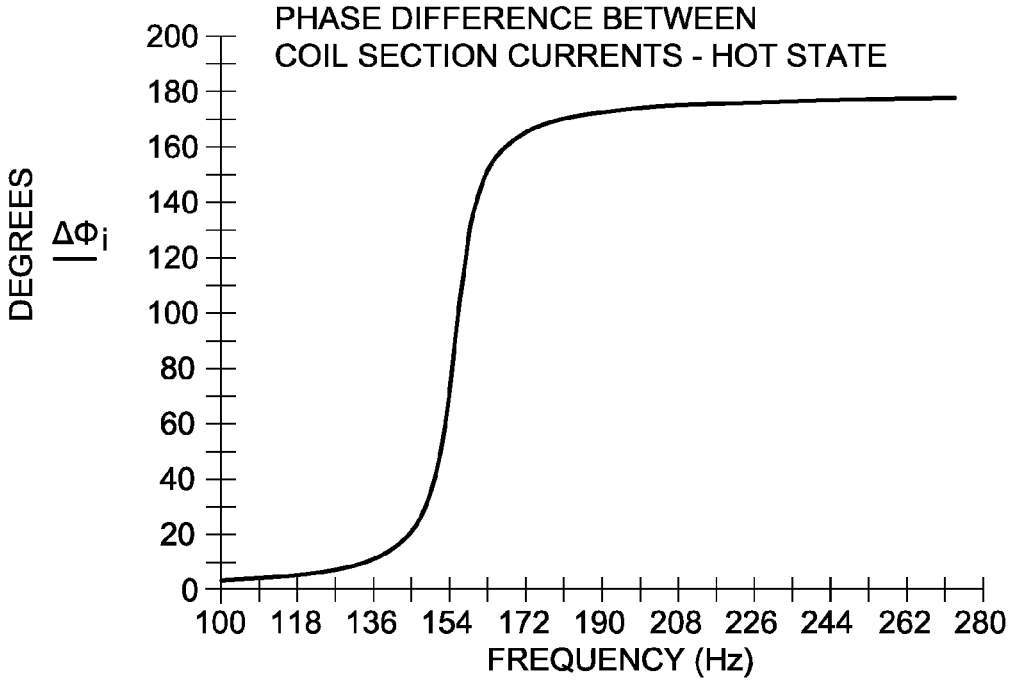

FIG. 6(*b*), FIG. 7(*b*) and FIG. 8(*b*) graphically illustrate current magnitudes for the currents in the active and passive load coils for the cold, warm and hot states, respectively, that are associated with the example of the invention represented by the power magnitudes in FIG. 6(*a*), FIG. 7(*a*) and FIG. 8(*a*) respectively.

FIG. 6(*c*), FIG. 7(*c*) and FIG. 8(*c*) graphically illustrate the difference in phase angle between the currents in the active and passive load coils for the cold, warm and hot states, respectively, that are associated with the example of the invention represented by the current magnitudes in FIG. 6(*b*), FIG. 7(*b*) and FIG. 8(*b*) respectively. Preferably, but not by way of limitation, the phase shift between the active and passive coil currents is kept sufficiently low, at least lower than 30 degrees, to minimize the difference in phase shift so that significant magnetic field cancellation does not occur between the fields generated around the active and passive coils.

Figure 1:
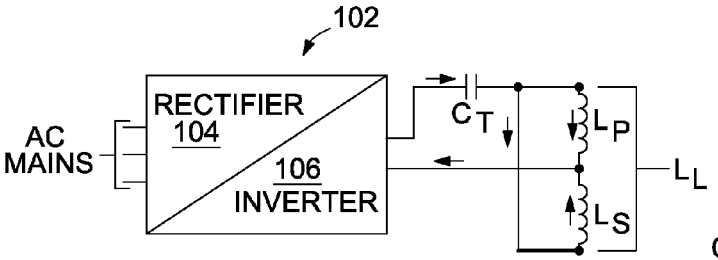
FIG. 1 PRIOR ART
FIG. 1 is a prior art circuit arrangement for inductively heating and melting an electrically conductive material.
Figure 2A:
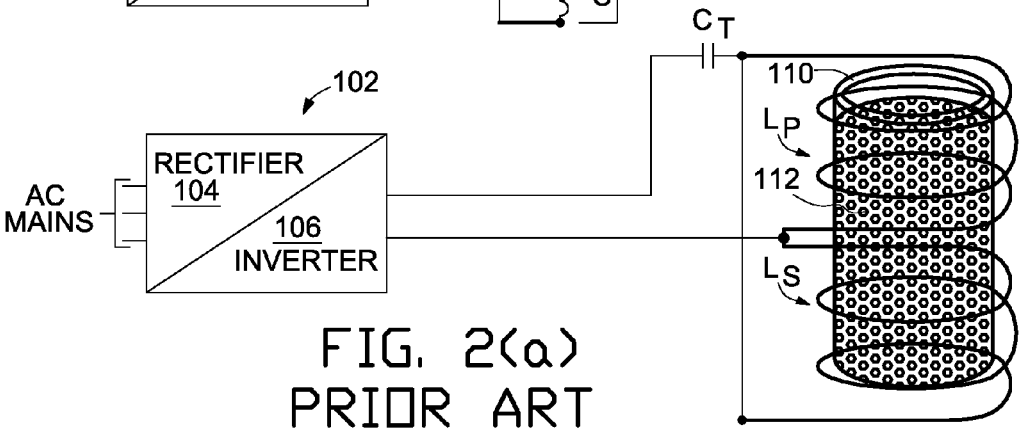
FIG. 2(a) PRIOR ART
FIG. 2(*a*) illustrates a prior art heating and melting process in a cold state wherein substantially none of the electrically conductive material is melted.
Figure 2B:
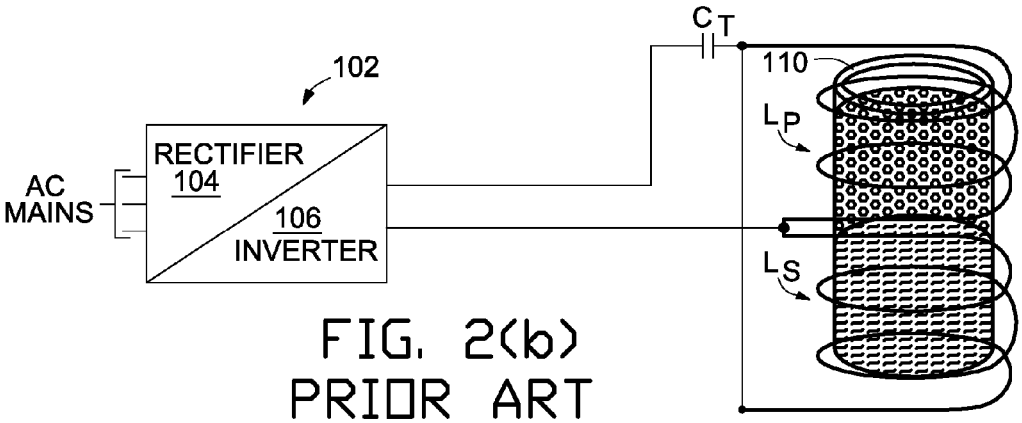
FIG. 2(b) PRIOR ART
Figure 2C:
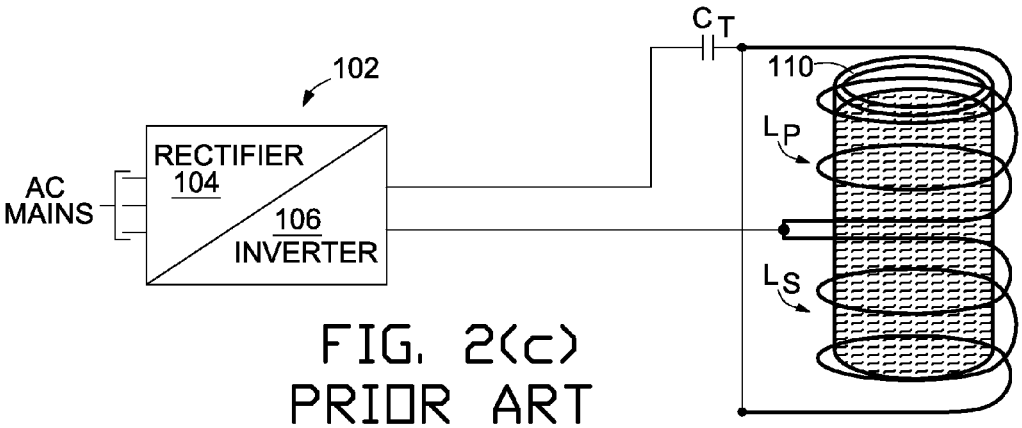
FIG. 2(c) PRIOR ART
Figure 3A:
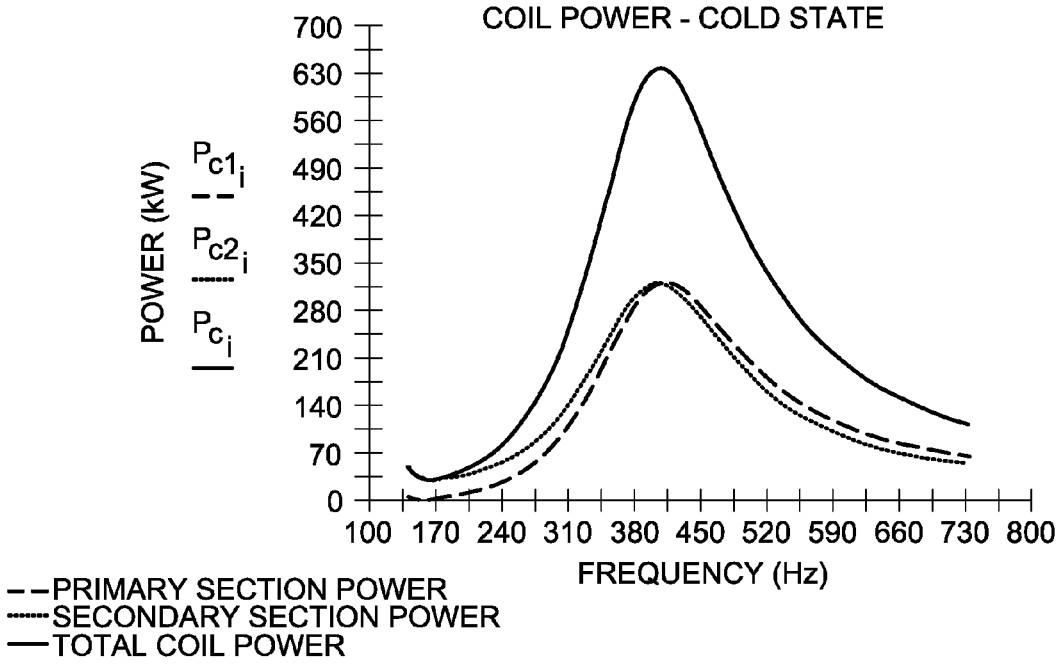
FIG. 3(a) PRIOR ART
FIG. 3(*a*) graphically illustrates power division between upper and lower induction coil sections for the prior art heating and melting cold state shown in FIG. 2(*a*) as a function of the frequency of the applied heating power.
Figure 3B:
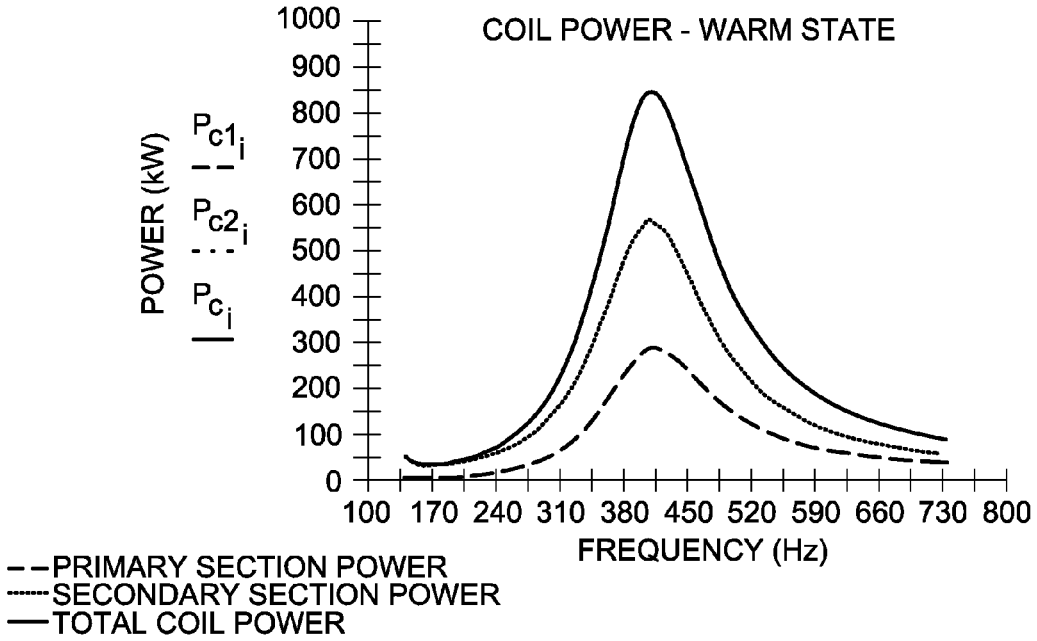
FIG. 3(b) PRIOR ART
Figure 3C:
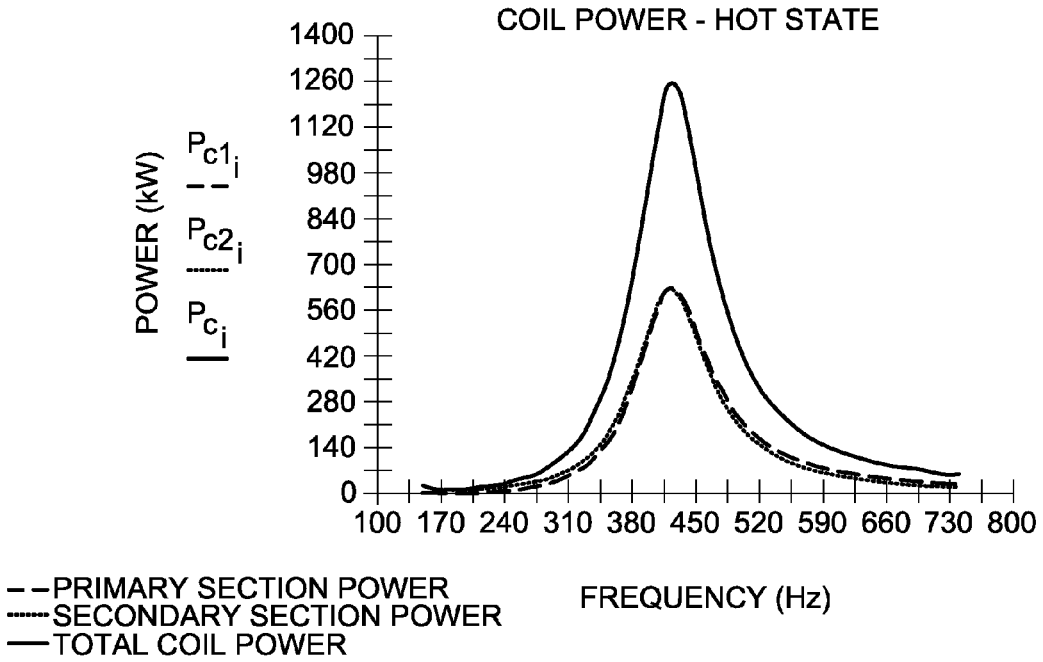
FIG. 3(c) PRIOR ART
Figure 4:
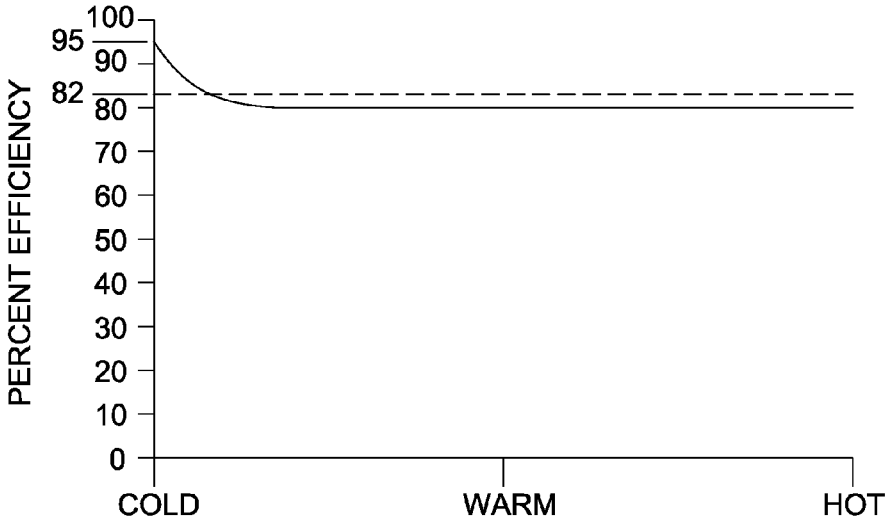
FIG. 4 PRIOR ART
FIG. 4 graphically illustrates the typical efficiency of the prior art heating and melting process.
Figure 9:
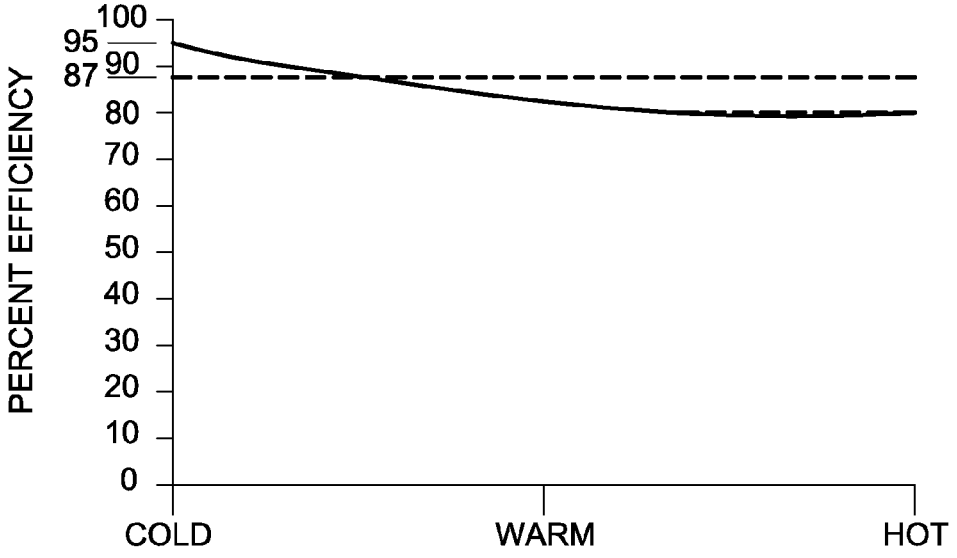
FIG. 9 graphically illustrates the typical efficiency achieved with one example of the electric induction control system of the present invention.

FIG. 9 graphically illustrates the typical efficiency of a batch melting process over the time of the process utilizing the induction melt process control system of the present invention. Comparing the solid line curve in FIG. 9 with the efficiency curve in FIG. 4, with the control system of the present invention, the efficiency of a batch melting process over the time of the process can be maintained at a higher value for a longer period of time, in comparison with the prior art process. Consequently average efficiency for the process, as illustrated by the dashed line in FIG. 9 will be higher (87 percent in this example), and the process can be accomplished in a shorter period of time.

Figure 10A:
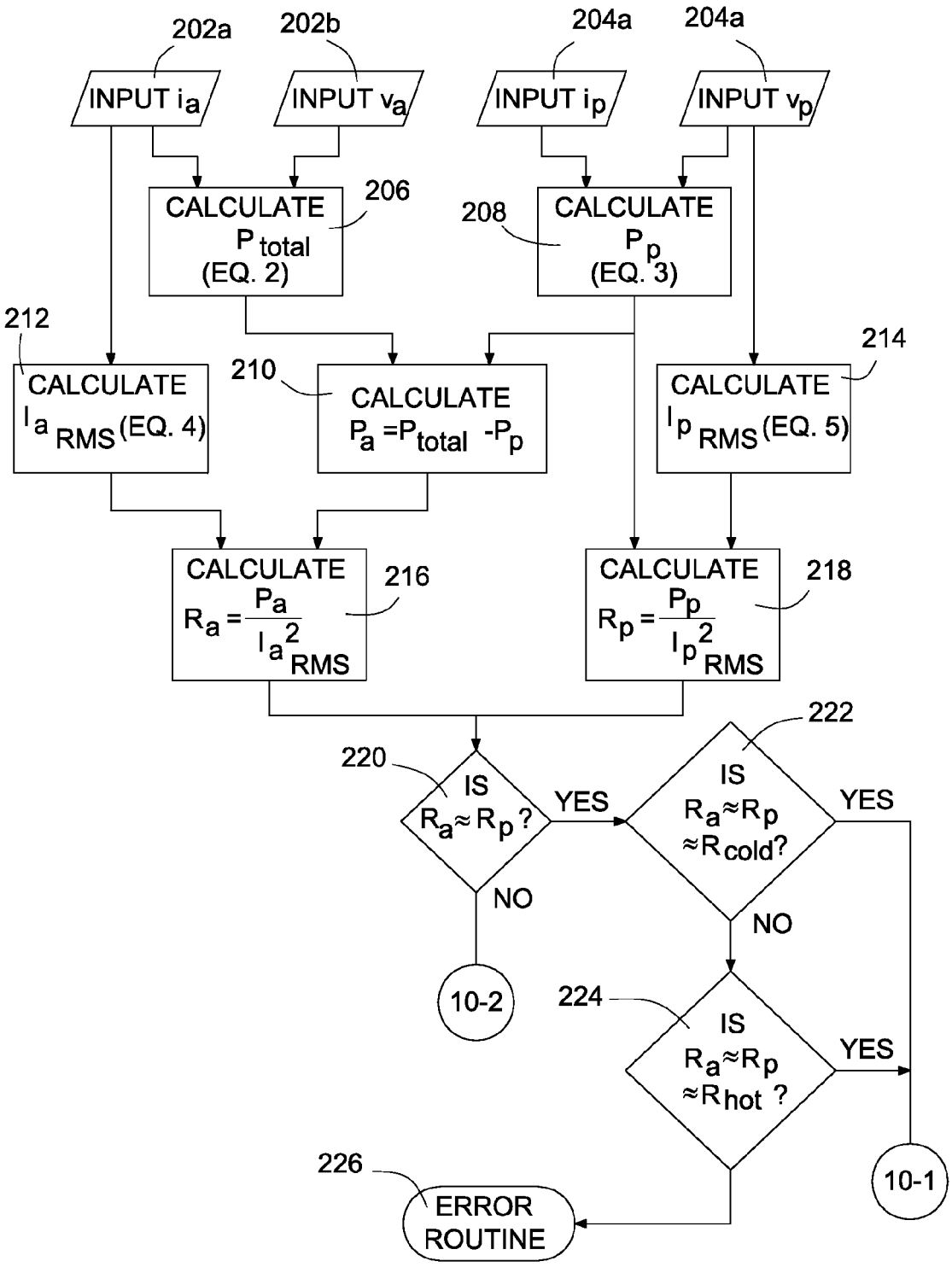
FIG. 10(*a*) and FIG. 10(*b*) is a flow chart illustrating one example of the electric induction control system of the present invention.
Figure 10B:
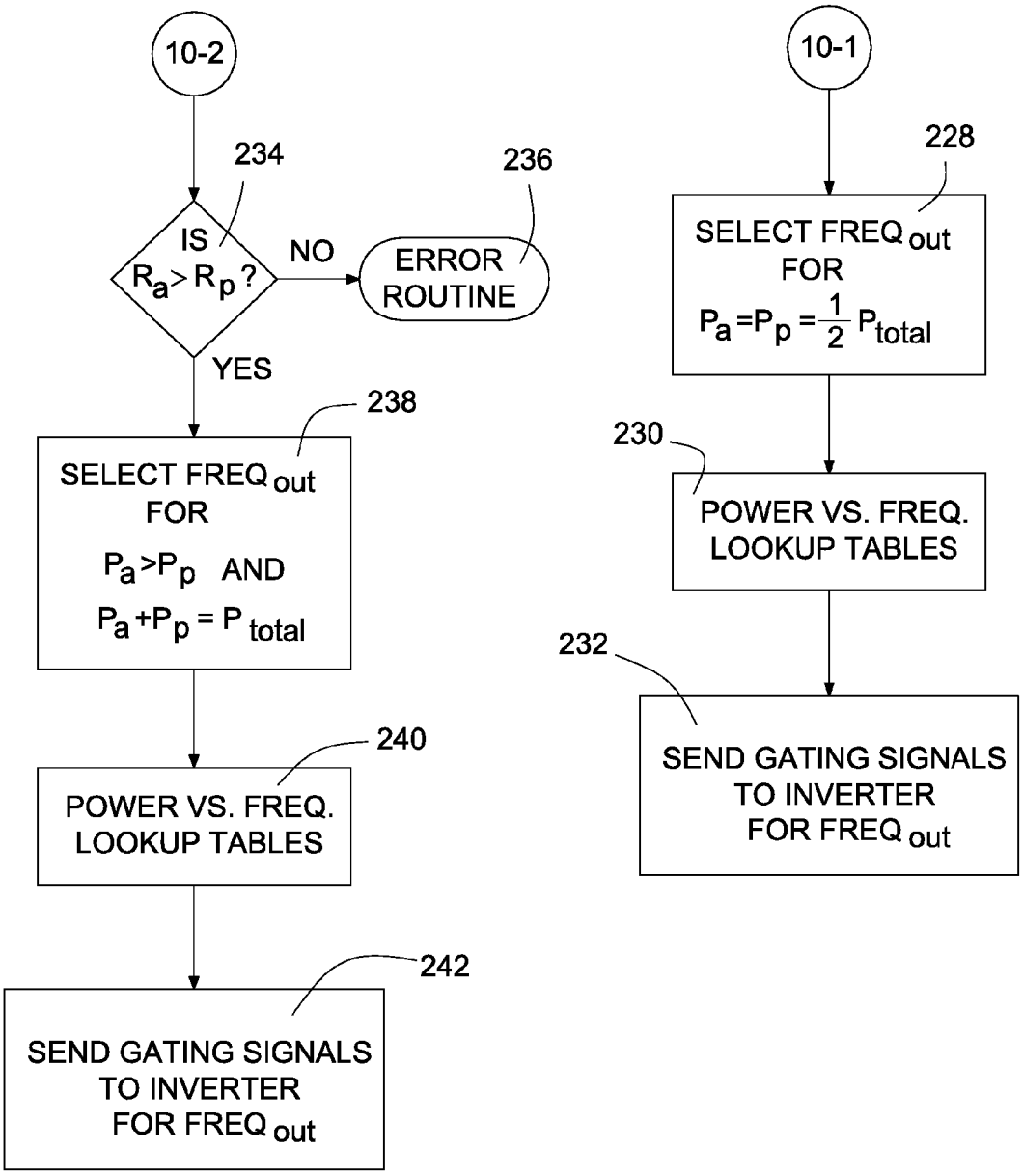

By way of example and not limitation, the electric induction melt control system of the present invention may be practiced by implementing the simplified control algorithm illustrated in the flow diagram presented in FIG. 10(*a*) and FIG. 10(*b*) with suitable computer hardware and software programming of the routines shown in the flow diagram. In FIG. 10(*a*), during a batch melting process, routines 202*a* and 204*a* periodically receive inputs from suitable current sensors that sense the instantaneous total load current, $i_a$, (both active and passive load circuits) and passive load current, $i_p$, respectively. Similarly routines 202*b* and 204*b* periodically receive inputs from suitable voltage sensors that sense the instantaneous load voltage across the active induction coil, $v_a$, and the instantaneous load voltage across the passive induction coil, $v_p$, respectively.

Routine 206 calculates total load power, $P_{total}$, from the following equation:

$$P_{total} = \frac{1}{T}\int^{T} i_a \cdot v_a \, dt, \qquad \text{[equation (2)]}$$

where T is the inverse of the output frequency of the inverter.

Routine 208 calculates passive load power, $P_p$, from the following equation:

$$P_p = \frac{1}{T}\int^{T} i_p \cdot v_p \, dt. \qquad \text{[equation (3)]}$$

Routine 210 calculates active load circuit power, $P_a$, by subtracting passive load power, $P_p$, from total load power, $P_{total}$.

Routine 212 calculates RMS active load circuit current, $I_{aRMS}$, from the following equation:

$$I_{aRMS} = \sqrt{\frac{1}{T}\int^{T} i_a^2 \, dt}. \qquad \text{[equation (4)]}$$

Similarly routine 214 calculates RMS passive load circuit current, $I_{pRMS}$, from the following equation:

$$I_{pRMS} = \sqrt{\frac{1}{T}\int^{T} i_p^2 \, dt}. \qquad \text{[equation (5)]}$$

Active load circuit resistance, $R_a$, is calculated by dividing active load circuit power, $P_a$, by the square of the RMS active load circuit current, $(I_{aRMS})^2$, in routine 216.

Similarly in routine 218 passive load circuit resistance, $R_p$, is calculated by dividing passive load circuit power, $P_p$, by the square of the RMS passive load circuit current, $(I_{pRMS})^2$.

Routine 220 determines if active load circuit resistance, $R_a$, is approximately equal to passive load circuit resistance, $R_p$. A preset tolerance band of resistance values can be included in routine 220 to establish the approximation band. If $R_a$ is approximately equal to $R_p$, routine 222 checks to see if these two values are approximately equal to the total load circuit resistance in the cold state, $R_{cold}$, when substantially all of the material in the crucible is in the solid state. For a given load circuit and crucible configuration, $R_{cold}$, may be determined by one skilled in the art by conducting preliminary tests and using the test value in routine 222. Further multiple values of $R_{cold}$ may be determined based upon the volume and type of the material in the crucible, with means for an operator to select the appropriate value for a particular batch melting process. If the approximately equal values of $R_a$ and $R_p$ are not approximately equal to the value of $R_{cold}$, routine 224 checks to see if these two values are approximately equal to the total load circuit resistance in the hot state, $R_{hot}$, when substantially all of the material in the crucible is in the molten state. For a given load circuit and crucible configuration, $R_{hot}$, may be determined by one skilled in the art by conducting preliminary tests and using the test value in routine 224. Further multiple values of $R_{hot}$ may be determined based upon the volume and type of the material in the crucible, with means for an operator to select the appropriate value for a particular batch melting process. If the approximately equal values of $R_a$ and $R_p$ are not approximately equal to the value of $R_{hot}$, error routine 226 is executed to evaluate why $R_a$ and $R_p$ are approximately equal to each other, but not approximately equal to $R_{cold}$ or $R_{hot}$.

If routine 222 or routine 224 determines that the approximately equal values of $R_a$ and $R_p$ are approximately equal to $R_{cold}$ or $R_{hot}$, as illustrated in FIG. 10(*b*), routine 228 uses power vs. frequency (POWER VS. FRQ.) cold or hot lookup tables 230, respectively, to select an output frequency, $FREQ_{out}$, for the inverter that will make the active load circuit power, $P_a$, substantially equal to the passive load circuit power, $P_p$. Routine 232 outputs appropriate signals to the gate control circuits for the switching devices in the inverter so that the inverter output frequency is substantially equal to $FREQ_{out}$.

If routine 220 in FIG. 10(*a*) determines that $R_a$ is not approximately equal to $R_p$, routine 234 in FIG. 10(*b*) determines if $R_a$ is greater than $R_p$; if not, error routine 236 is executed to evaluate the abnormal state wherein $R_a$ is less than $R_p$.

If routine 234 in FIG. 10(*b*) determines that $R_a$ is greater than $R_p$, then routine 238 uses power vs. frequency lookup table 240, to select an output frequency, $FREQ_{out}$, for the inverter that will make the active load circuit power, $P_a$, greater than the passive load circuit power, $P_p$, while the sum of the active and passive load circuit power remains equal to $P_{total}$. Routine 242 outputs appropriate signals to the gate control circuits for the switching devices in the inverter so that the inverter output frequency is substantially equal to $FREQ_{out}$.

Generally, but not by way of limitation, $P_{total}$ will remain constant throughout the batch melting process. Values in power vs. frequency lookup tables 230 and 240 can be predetermined by one skilled in the art by conducting preliminary tests and using the test values in lookup tables 230 and 240. Adaptive controls means can be used in some examples of the invention so that values in power vs. frequency lookup tables 230 and 240 are refined during sequential batch melting processes, based upon melt performance maximization routines, for use in a subsequent batch melting process.

Figure 11A:
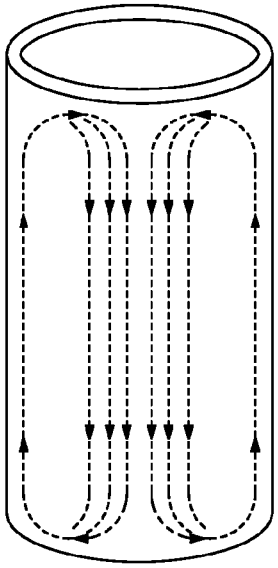
FIG. 11(*a*) and FIG. 11(*c*) illustrate electromagnetic flow patterns for molten material in a crucible or susceptor vessel, respectively, with the electric induction control system of the present invention when the electrical phases between the active and passive load circuit currents are approximately 90 electrical degrees.
Figure 11B:
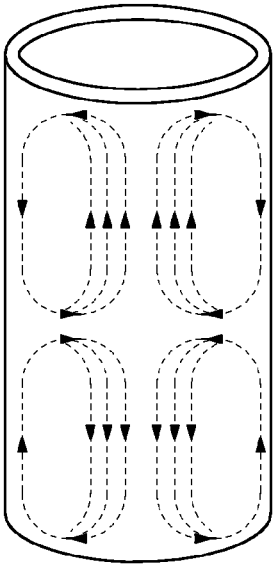
Figure 11C:
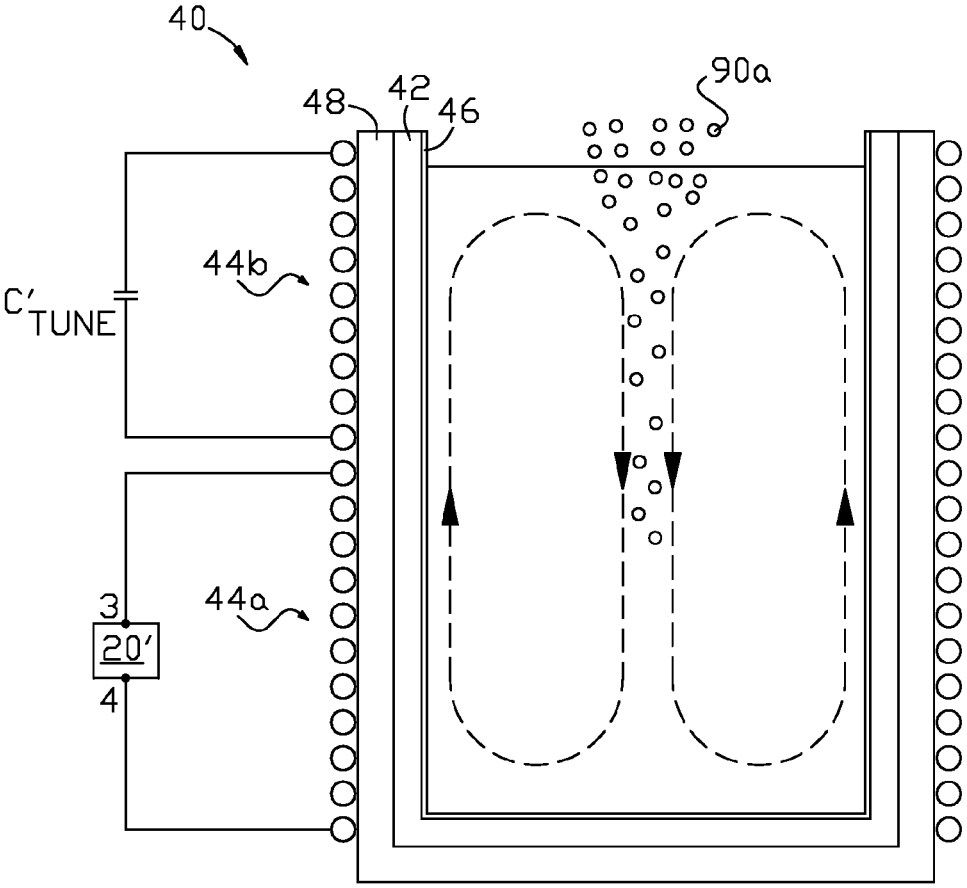

Optionally stirring of the melt in the hot state may be achieved by selecting an inverter output frequency at which the phase shift between the active and passive coil currents is approximately 90 electrical degrees. This mode of operation forces melt circulation from the bottom of the crucible to the top, as illustrated in FIG. 11(*a*), and is generally preferred to the typical circulation in which the melt in the top half of the crucible has a circulation pattern different from that in the bottom half of the crucible as illustrated in FIG. 11(*b*). As can be seen from FIG. 6(*c*), FIG. 7(*c*) and FIG. 8(*c*), the operating frequencies for a 90 degrees phase shift result in relatively low heating power (FIG. 6(*a*), FIG. 7(*a*) and FIG. 8(*a*)). However the stirring mode is generally used after an entire batch of material is melted, and can be used intermittently if additional heating power is required to keep the batch melt at a desired temperature.

Figure 12:
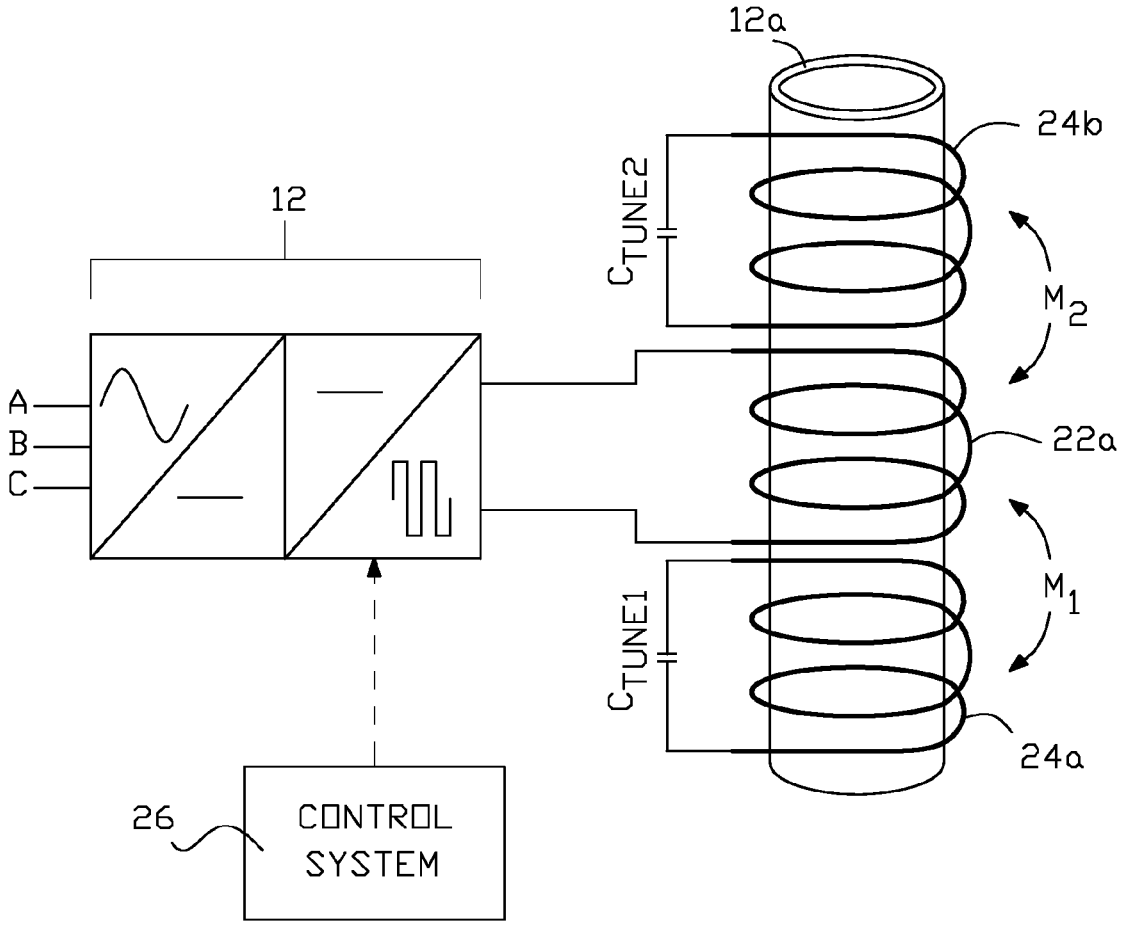
FIG. 12 illustrates in simplified schematic and diagrammatic form another example of the electric induction control system of the present invention.

FIG. 12 illustrates another example of the electric induction control system of the present invention. In this example ac power supply 12 provides power to active induction coil 22*a* (active coil section) to form the active circuit. Passive induction coils 24*a* and 24*b* (passive coil sections) are connected in parallel with capacitive elements $C_{TUNE1}$ and $C_{TUNE2}$, respectively, to form two separate passive circuits. Passive induction coils 24*a* and 24*b* are magnetically coupled (diagrammatically illustrated by arrows with associated $M_1$ and $M_2$ in the figure) with the primary magnetic field created by the flow of current in the active circuit, which in turn, generates currents in the passive circuits that generate secondary magnetic fields around each of the passive induction coils. Electrically conductive workpiece 12*a* can be located within the active and passive coils. The primary magnetic field will electromagnetically couple substantially with the middle zone of the workpiece in this particular non-limiting arrangement of the active and passive coils to inductively heat the workpiece in that region. The secondary magnetic field for bottom passive induction coil 24*a* will substantially couple with the bottom zone of the workpiece to heat that region; and the secondary magnetic field for top passive induction coil 24*b* will substantially couple with the top zone of the workpiece to heat that region. By suitably selecting impedances for the active and passive circuits, for example by selected capacitance values for the capacitive elements and/or inductance values for the induction coils, two or more of the coil circuits can be tuned to a different resonant frequency so that when the output frequency of the power supply is changed, those coil circuits will operate at different resonant frequencies for maximum applied induced power to the region of the material surrounded by the coil operating at resonant frequency.

Figure 13:
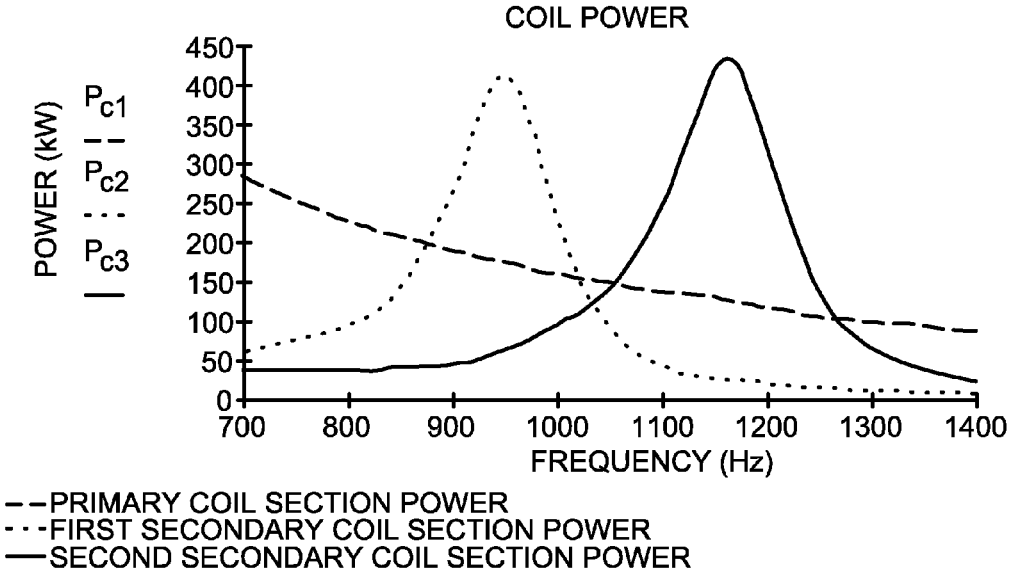
FIG. 13 illustrates power division between active induction coil and passive induction coils for an example of the present invention illustrated in FIG. 12 where the output frequency of the power supplied is changed to vary the applied induction power to different sections of an electrically conductive material.

FIG. 13 graphically illustrates the change in magnitude of applied induced power to each of the three zones of the electrically conductive material when the output frequency of the power supply is changed for one example of the invention. Referring to FIG. 12 and FIG. 13, in this non-limiting example of the invention, power ($P_{c1}$) in the active circuit (labeled PRIMARY COIL SECTION POWER in FIG. 13) decreases as frequency is increased; power ($P_{c2}$) in the bottom passive circuit (labeled FIRST SECONDARY COIL SECTION POWER in FIG. 13) peaks at a resonant frequency of about 950 Hertz; and power ($P_{c3}$) in the top passive circuit (labeled SECOND SECONDARY COIL SECTION POWER in FIG. 13) peaks at a resonant frequency of about 1,160 Hertz. For this particular example, the active coil circuit does not have a resonant frequency over the operating range; in other examples of the invention, the active coil circuit may also have a resonant frequency. It is not necessary to operate at resonant frequency; establishment of discrete resonant frequencies allow operating over a frequency range while controlling the amount of power distributed to each zone. The invention also comprises examples wherein two or more active circuits may be provided and each of those active circuits may be coupled with one or more passive circuits.

Figure 14:
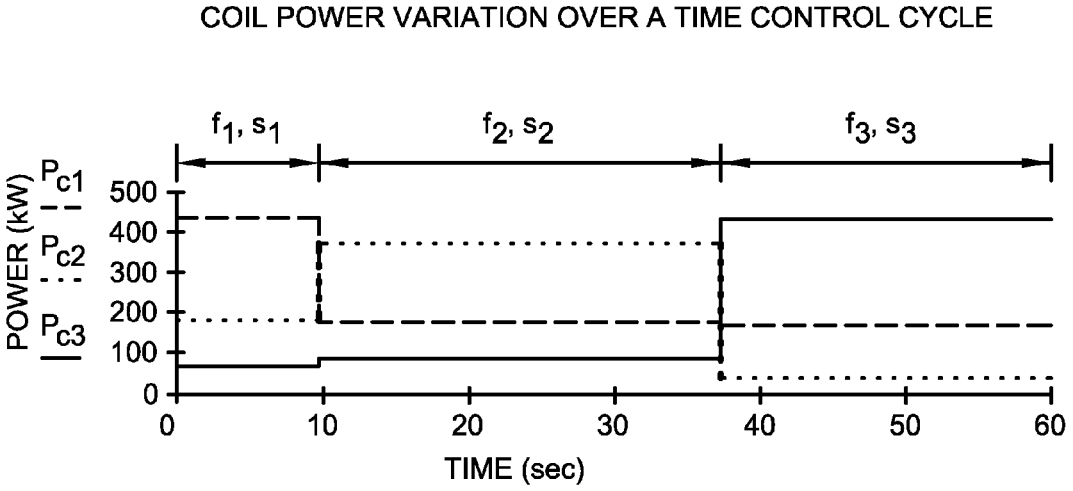
FIG. 14 illustrates one example of the time distribution of applied induction power to different sections of an electrically conductive material for an example of the present invention illustrated in FIG. 12.

FIG. 14 graphically illustrates another example of the present invention as applied to the circuit shown in FIG. 12. Induced power may be applied to each of the three zones of the electrically conductive material at selected different frequencies for different time periods making up a control cycle, which is 60 seconds in this example, to achieve a particular heating pattern of the material. Power is supplied sequentially from the power supply over the control cycle as follows: power at frequency $f_1$ for approximately 10 seconds ($s_1$); power at frequency $f_2$ for approximately 27 seconds ($s_2$); and power at frequency $f_3$ for approximately 23 seconds ($s_3$). With this control scheme, although instantaneous power may be quite different from zone to zone as shown in FIG. 14, time average power values over a control cycle for each zone can be made substantially the same by suitable selection of resonant frequencies for the passive circuits.

The term "electrically conductive workpiece" includes a susceptor, which can be a conductive susceptor formed, for example, from a graphite composition, which is inductively heated. The induced heated is then transferred by conduction or radiation to a workpiece moving in the vicinity of the susceptor, or a process being performed in the vicinity of the susceptor. For example a workpiece may be moved through the interior of a susceptor so that it absorbs heat radiated or conducted from the inductively heated susceptor. In this case the workpiece may be a non-electrically conductive material, such as a plastic. Alternatively a process may be performed within the susceptor, for example a gas flow through the susceptor may absorb the heat radiated or conducted from the inductively heated susceptor. Heat absorption by the workpiece or process along the length of the susceptor may be non-uniform and the induction control system of the present invention may be used to direct induced power to selected regions of the susceptor as required to account for the non-uniformity. Generally whether the process is the heating of a workpiece moving near a susceptor, or other heat absorbing process is performed neared the susceptor, all these processes are referred to as "heat absorbing processes."

Zone temperature data for the workpiece may be inputted to control system 26 as the heating process is performed. For example, for a susceptor, temperature sensors, such as thermocouples, may be located in each zone of the susceptor to provide zone temperature signals to the control system. The control system can process the received temperature data and regulate output frequency of the power supply as required for a particular process. In some examples of the invention output power level of the power supply may be kept constant; in other examples of the invention, power supply output power level (or voltage) can be changed by suitable means, such as pulse width modulation, along with the frequency. For example if the overall temperature of the electrically conductive material is too low, the output power level from the power supply may be increased by increasing the voltage pulse width.

In other examples of the invention, the susceptor may be a susceptor vessel that is surrounded by at least one active (primary) coil and at least one passive (secondary) coil, and is used to heat and melt a transition material that is substantially non-electrically conductive in the solid (cold) state and electrically conductive in the non-solid (warm or hot) state. For example heating and melting system 40 in FIG. 15(*a*), FIG. 16(*a*) and FIG. 17(*a*) comprises susceptor vessel 42, which is surrounded by at least lower active induction coil 44*a* and at least one passive upper induction coil 44*b*. If transition material 90*a* is reactive with the composition of susceptor vessel 42, the susceptor can be optionally lined with a physical barrier or liner 46 to prevent contact of the transition material with the interior wall of the susceptor vessel. One non-limiting choice for the liner is a silica liner. Thermal insulating space 48 may be provided between the exterior wall of the susceptor vessel and the induction coils. This space may be occupied by any type of insulator, including solid (for example a ceramic composition) or graphite powder fillers.

Figure 18:
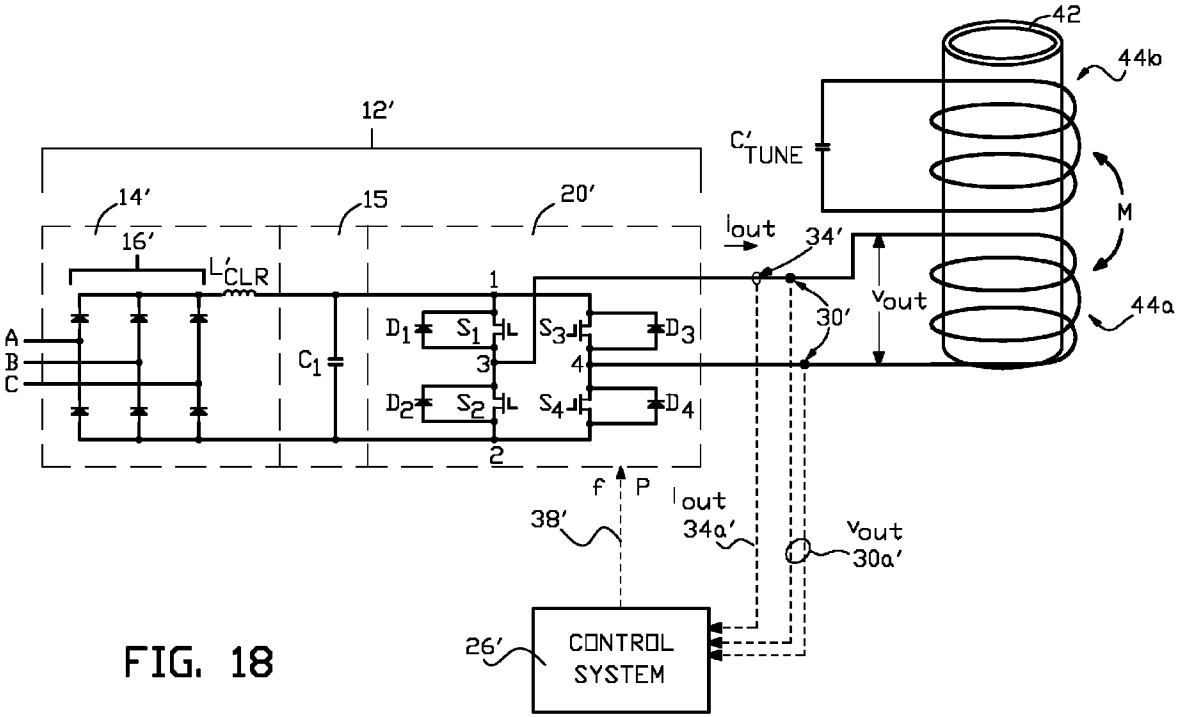
FIG. 18 illustrates in simplified schematic and diagrammatic form one example of the electric induction control system of the present invention used to heat and melt a transition material in a susceptor vessel.

AC power is supplied to lower active induction coil 44*a* from a variable frequency output power supply. One suitable supply is power supply 12 as illustrated in FIG. 5 with tuning capacitor $C_{TANK}$ located at the output of inverter section 20. Another suitable supply is power supply 12' shown in FIG. 18. Ac-to-dc rectifier and filter section 14' includes ac-to-dc rectifier 16' and optional current limiting reactor $L'_{CLR}$ to smooth out the ripple current from the dc output of the rectifier. Intermediate capacitor section 15 is diagrammatically illustrated as capacitor $C_1$, which can be a single capacitor or a bank of interconnected capacitors that form a capacitive element. In FIG. 18, the dc output of the rectifier is supplied to input terminals 1 and 2 of a full-bridge inverter in inverter section 20'. The inverter comprises solid state switches $S_1$, $S_2$, $S_3$ and $S_4$ and associated antiparallel diodes $D_1$, $D_2$, $D_3$ and $D_4$, respectively. Alternating turn-on/turn-off cycles of switch pairs $S_1/S_4$ and $S_2/S_3$ produce a synthesized ac inverter output at terminals 3 and 4. A preferred, but not limiting, choice of component for the solid state switch is an isolated gate bipolar transistor (IGBT), which exhibits the desirable characteristics of power bipolar transistors and power MOS-FETs at high operating voltages and currents. The inverter may optionally employ a phase-shifting scheme (pulse width control) relative to the turn-on/turn-off cycles of the two switch pairs whereby variable overlapping on-times for the two switch pairs is used to vary the effective RMS output voltage of the inverter. The capacitance of capacitor $C_1$ is selected to form a resonant circuit with the impedance of the load circuit when substantially all of the transition material in the susceptor vessel is in the molten (hot) state and the inverter is set at the hot state operating frequency as further described below. AC current flowing through active induction coil 44*a* from the output of the inverter generates a magnetic field around the active induction coil that selectively couples with the susceptor vessel and/or transition material inside the susceptor vessel, and passive induction coil 44*b* as the heating and melting process progresses through the cold, warm and hot operating states as further described below. One type of suitable power supply that can be used with heating and melting process of the present invention is further described in U.S. Pat. No. 6,696,770, which is incorporated herein by reference in its entirety.

Upper induction coil 44*b* forms a passive coil circuit in combination with resonant tuning capacitor $C'_{TUNE}$ whereby current flow through active induction coil 44*a* in the active coil circuit generates an ac magnetic field that effectively couples with passive induction coil 44*b* in the hot operating state as further described below. Magnetic coupling with induction coil 44*b* generates a substantial current flow in the passive coil circuit when the operating frequency of the output of the power supply is at or near resonance, which occurs when the inverter's output is the hot state operating frequency as further described below.

Figure 15B:
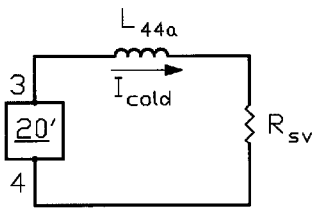
FIG. 15(*a*) is one example of a heating and melting system of the present invention with illustration of typical magnetic flux lines when substantially all transition material in a susceptor vessel is non-electrically conductive in the cold state.
Figure 15C:
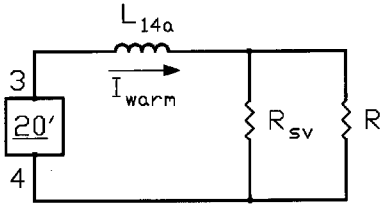
Figure 15A:
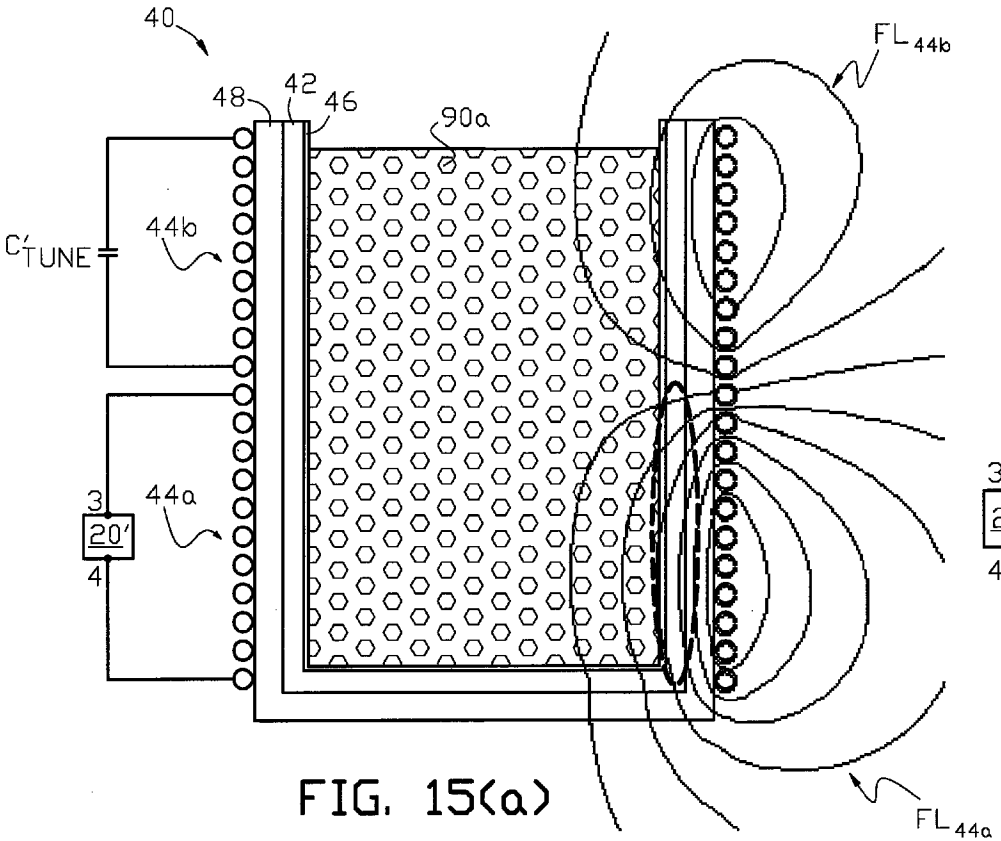

In FIG. 15(*a*) transition material 90*a* placed in the susceptor vessel is initially in the solid non-electrically conductive (cold) state (diagrammatically illustrated as circles). Consequently the initial output frequency, $f_{cold}$, of power supply 12' is selected from equation (1) above to limit the standard depth of penetration (Δ) to the wall thickness, t, of the susceptor vessel. Rearranging the terms of equation (1) to solve for $f_{cold}$, and substituting wall thickness, t, for the standard depth of penetration, and $\rho_{sv}$ for the resistivity of the susceptor vessel, results in $$f_{cold} = 2.53 \cdot 10^5 \cdot \frac{\rho_{sv}}{t^2}, \qquad \text{[equation (6)]}$$

as the cold state operating frequency $f_{cold}$ that satisfies the above limiting condition.

Primary magnetic flux (represented by flux lines $FL_{44a}$ in FIG. 15(*a*)) is generated by the flow of ac current in active coil 44*a*. As shown in FIG. 15(*a*) with the output of the power supply set to the cold state operating frequency and the capacitance of $C'_{TUNE}$ selected so that the passive coil circuit is not at resonance at the cold state operating frequency, magnetic flux $FL_{44a}$ couples primarily with the lower wall (region outlined in dashed lines) of the susceptor vessel to electromagnetically heat the lower wall of the vessel. Heat from the susceptor vessel's wall is conducted to solid transition material 90*a* adjacent to the lower inner wall of the susceptor vessel. Further since the passive circuit is not at resonance, magnetic flux lines $FL_{44b}$ are low in intensity and the upper wall of the susceptor vessel is not significantly heated. Typically, but not by way of limitation, the utilized initial cold state operating frequency, $f_{cold}$, is reduced to no more than 20 percent of the value of $f_{cold}$ calculated from equation (6) to allow some inductive melting of the transition material in the susceptor vessel around the interior wall of the susceptor as the transition material begins to melt and becomes electrically conductive.

During the initial cold state heating stage, the equivalent load circuit impedance reflected at the output of the power supply comprises inductance $L_{44a}$ of coil 44*a* in the active coil circuit and the resistance, $R_{sv}$, of the susceptor vessel as illustrated in FIG. 15(*b*). The resistance of the susceptor vessel can be calculated from the following equation:

$$R_{sv} = \frac{P_{cold}}{I_{cold}^2}, \quad \text{[equation (7)]}$$

where $R_{sv}$ is the resistance of the susceptor vessel in ohms;

$P_{cold}$ is the magnitude of output power (in watts) of the inverter at the cold state operating frequency; and $I_{cold}$ is the magnitude of current (in amperes) flowing through induction coil 44*a* at the cold state operating frequency when the transition material is substantially in the solid non-electrically conductive (cold) state.

If a liner is used, then the induced power density in the liner material should be limited to the thermal withstand density of the liner material. For example if a graphite susceptor vessel and silica liner is used, the induced power density in the susceptor vessel should be limited to approximately no greater than 5 watts per square centimeter since silica will begin to deform if subjected to a higher power density.

As the heating and melting process proceeds from the cold to warm state, the output frequency of the inverter is lowered from $f_{cold}$ to an intermediate frequency $f_{warm}$, which results in increasing flux coupling with the increasing volume of electrically conductive molten transition material, and decreasing flux coupling with the susceptor vessel. For example if the transition material in the susceptor vessel is silicon, when the silicon reaches a nominal melting temperature of 1,410° C., the molten silicon will become susceptible to a portion of the electromagnetic field penetrating into the susceptor vessel. As the inverter's output frequency is decreased, induced power to the susceptor vessel decreases while induced power to the melting transition material increases through the warm state until there is effective coupling between the active and passive coil circuits as further described below.

In this warm intermediate state, when a batch of transition material in the susceptor vessel is partially molten, for a given magnitude of inverter output power, the inverter's output current will increase since the high resistance of the susceptor vessel is being shunted with the lower resistance $R_{tm(warm)}$ of the partially molten bath as shown in FIG. 15(*c*). Resistance $R_{tm(warm)}$ continues to decrease as more of the partially molten transition material in the susceptor vessel continues to melt until there is effective coupling between the active and passive coil circuits as further described below. The equivalent resistance $R_{eq}$ of the partially molten bath and susceptor vessel at any point during the progressive melting process can be calculated from the following equation:

$$R_{eq} = \frac{P_{warm}}{I_{warm}^2}, \quad \text{[equation (8)]}$$

where $P_{warm}$ is magnitude of output power (in watts) of the inverter at the warm state operating frequency; and $I_{warm}$ is the magnitude of current (in amperes) flowing through induction coil 44*a* at the warm state operating frequency when the transition material is in the partially molten (warm) state.

The resistance of the molten material, $R_{tm}$, at any point during the melting process can be calculated from the equation:

$$R_{tm} = \frac{R_{eq} \cdot R_{sv}}{R_{sv} - R_{eq}}, \quad \text{[equation (9)]}$$

where the equivalent resistance, $R_{eq}$, of the susceptor vessel and the electrically conductive transition material in the susceptor vessel are calculated from equation (8) above.

The melting process is complete when substantially all transition material in the susceptor vessel is in the molten electrically conductive (hot) state and the output frequency of the inverter is equal to the resonant, or near resonant, frequency $f_{hot}$ of the passive coil circuit comprising induction coil 44*b* and capacitor $C'_{TUNE}$. The frequency $f_{hot}$ can be calculated from the following equation:

$$f_{hot} = \frac{1}{2 \cdot \pi \sqrt{L_{44b} \cdot C'_{TUNE}}}, \quad \text{[equation (10)]}$$

where $L_{44b}$ is the inductance (in Henries) of induction coil 44*b*; and $C'_{TUNE}$ is the capacitance (in Farads) of resonant capacitor $C'_{TUNE}$ in the passive coil circuit.

Inductively coupling passive induction coil 44*b* with the magnetic field generated by the flow of current through induction coil 44*a* creates a magnetic field in the volume of electrically conductive transition material surrounded by induction coil 44*b* since the phase of the current flowing in passive induction coil 44*b* lags behind the phase of the current flowing in active induction coil 44*a*.

Figures 16A, 16B, 16C:
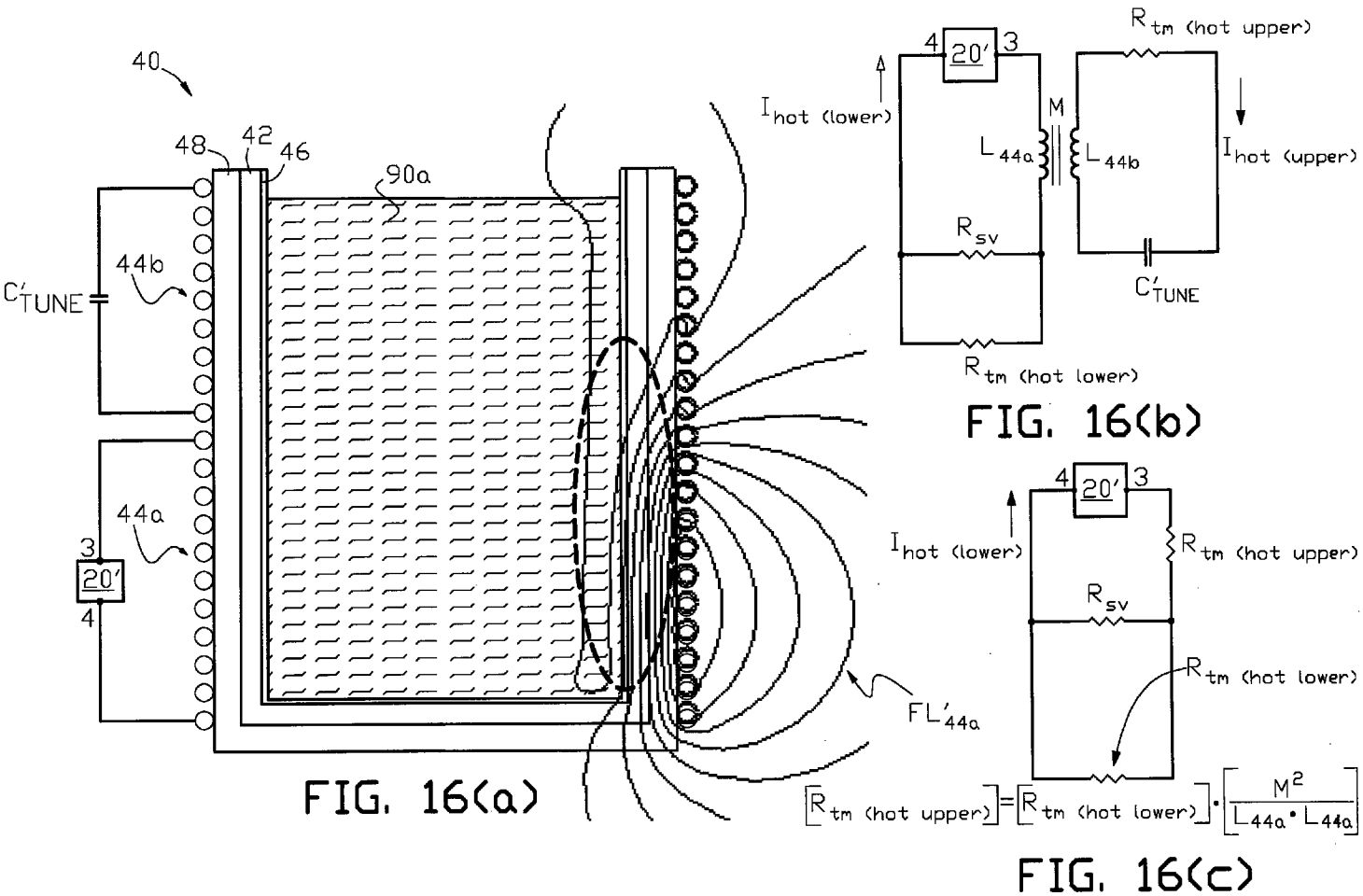
FIG. 16(*a*) and FIG. 17(*a*) are the heating and melting system shown in FIG. 15(*a*) with illustration of typical magnetic flux lines when substantially all transition material in the susceptor vessel is in the molten state and electrically conductive hot state with current flowing in the primary induction coil is at zero degrees phase angle or ninety degrees phase angle, respectively, as illustrated in FIG. 17(*b*).
Figures 17A, 17B:
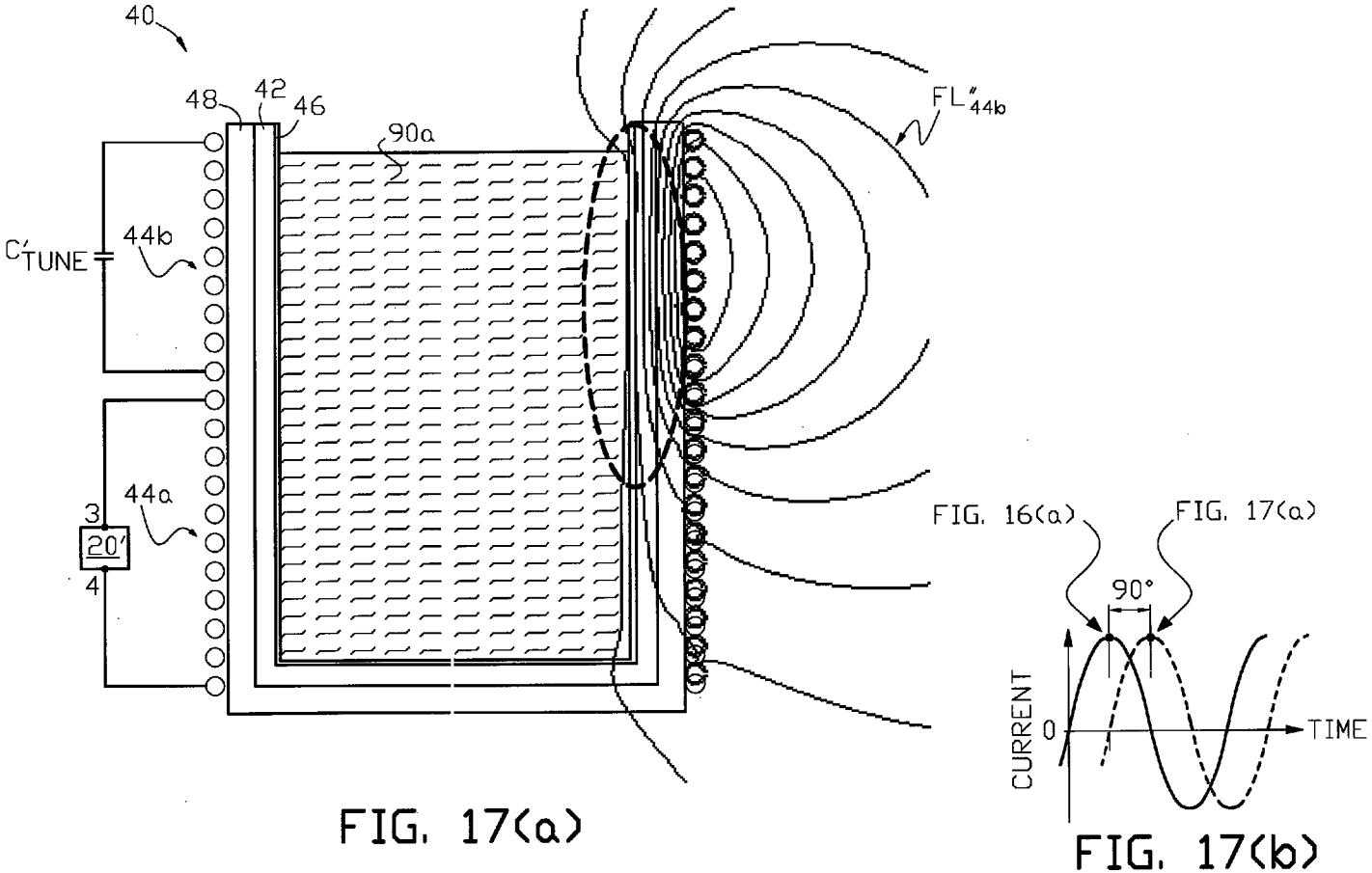

FIG. 16(*a*) and FIG. 17(*a*) illustrate exemplary flux lines $FL'_{44a}$ and $FL''_{44b}$ for the magnetic field generated when the inverter output is set at the hot state (near resonant) frequency. With reference to the inverter's output current diagram in FIG. 17(*b*), the flux lines in FIG. 17(*a*) represent the approximately 90 degrees out-of-phase current flow (curve shown in dashed line) in passive induction coil 44*b* from the current flow (curve shown in solid line) in active induction coil 44*a*.

FIG. 16(*b*) illustrates the equivalent electrical load circuit for the heating and melting system when operating in the hot state and there is effective magnetic coupling between the active and passive coil circuits. As illustrated in the corresponding equivalent electrical load circuit in FIG. 16(*c*), the equivalent resistance of the molten transition material in the susceptor vessel reflected at the output of the inverter is increased since a significant portion of the equivalent electrical resistance of the upper volume of molten transition material in the susceptor vessel is effectively connected in series with the equivalent electrical resistance of the lower volume of the molten transition material. This increased equivalent resistance improves the power factor of active induction coil 44*a* and results in less output current for induced heating power to the molten transition material in comparison to a coil arrangement that does not use a passive coil circuit.

In the hot state, the current in the active induction coil generates a magnetic field that effectively couples with the passive induction coil since the passive coil circuit is operating at a near resonant (hot state) frequency. At the hot state operating frequency, the current in the passive induction coil resonates with the resonant capacitor. This increases the magnitude of current flow in the passive coil circuit, and with an approximately ninety degrees phase shift between current flow in the active and passive coils, a running electromagnetic wave is established in the molten batch of transition material in the susceptor vessel. As previously described above and shown in FIG. 11(*a*), this causes the mass of molten transition material to circulate from the bottom of the susceptor vessel upwards along the interior wall of the vessel and then downwards through the central vertical region, or axis, of the molten transition material in the vessel. While moving up along the interior wall of the susceptor vessel the transition material is being heated by induced electric current flow penetrating across the flow of the transition material near the inner wall of the susceptor vessel. Therefore additional transition material 90*a* in the substantially non-electrically conductive state that is added to the transition material in the susceptor vessel is pulled into the flow pattern and rapidly transitions to the molten state as illustrated in FIG. 11(*c*) to prevent the formation of a solid transition material layer (crust) over the surface of the molten transition material in the susceptor vessel.

The following table summarizes parameters in the cold, warm and hot states.

| | Operating states | | |
|---|---|---|---|
| Parameter | Cold state | Warm state | Hot state |
| Frequency | Generally selected as a fixed frequency until the solid transition material begins to melt. Active and passive load circuits not operating at resonance. | Selected to increase inductive heating of partially molten transition material in the lower region of the crucible vessel. | Selected to operate the active and passive load circuits at, or near, resonance and/or to establish an electromagnetic flow of transition material in the vessel up along the inner wall of the vessel and down along the central axis of the vessel. |
| Induced power | Selected for maximum induced heating of the lower wall of susceptor vessel without exceeding the thermal withstand density of a liner, if a liner is used | Selected to maximize induced heating of the partially molten transition material to shorten the time required to melt the remainder of the transition material. | Selected to hold the molten transition material in the susceptor vessel at a desired temperature prior to removal of the molten transitional material from the vessel, or solidification of the molten material in the vessel. |

Figures 19A, 19B:
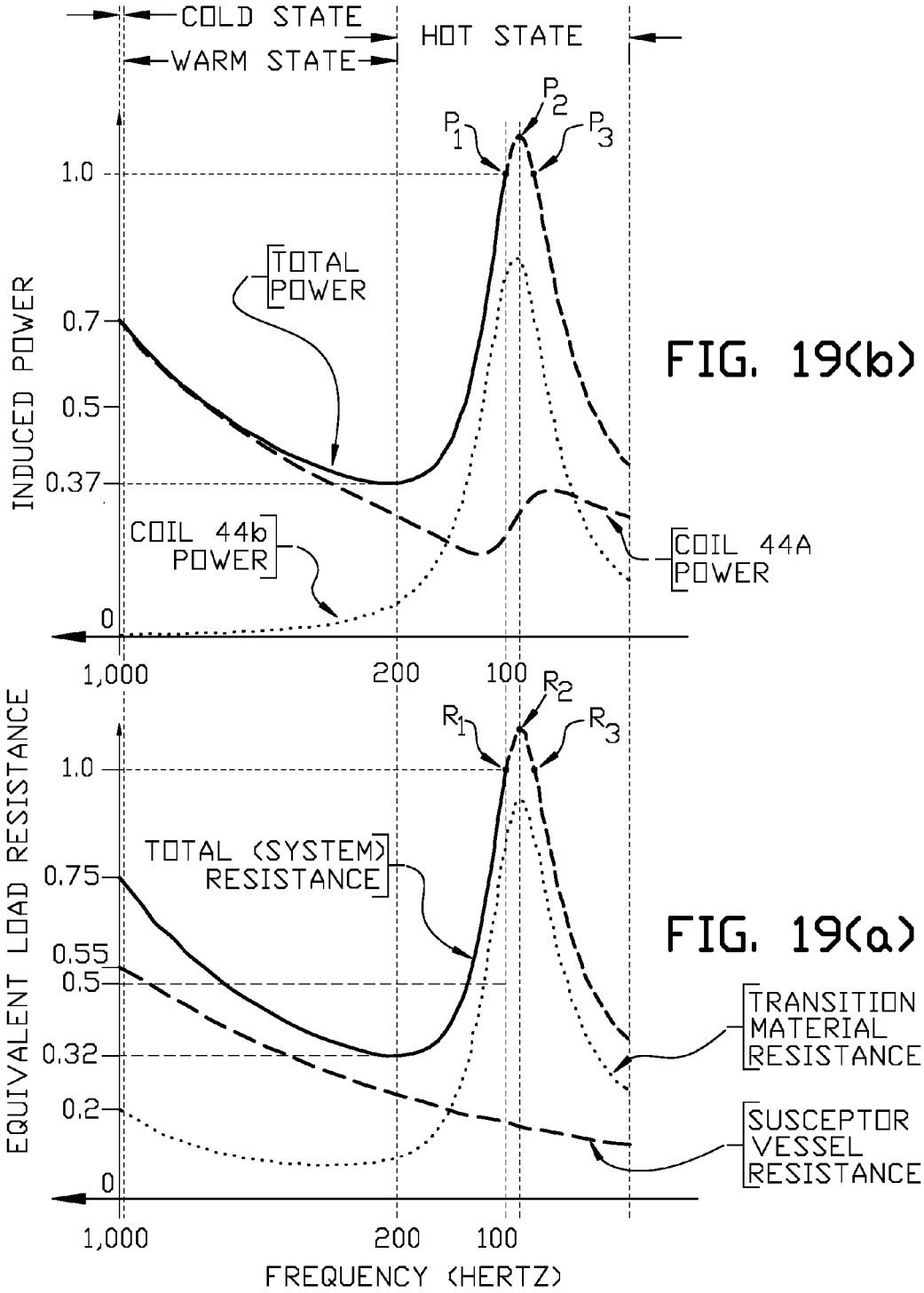
FIG. 19(*a*) graphically illustrates the change in equivalent load resistance relative to operating frequency for one example of the heating and melting system of the present invention as the transition material in the susceptor vessel progresses through the cold, warm and hot states.

FIG. 19(*a*) graphically illustrates typical changes in equivalent load resistance, $R_{eq}$, relative to the power supply's (inverter's) output frequency as the heating and melting process of a transition material in a susceptor vessel progresses through the cold, warm and hot stages for the following non-limiting example of the invention. For example in the cold state, cold state operating frequency, $f_{cold}$, may be 1,000 Hertz with a normalized $R_{eq(cold)}$ of approximately 0.75 as shown in FIG. 19(*a*). When heating and melting of the transition material progresses to the warm state as described above, warm state operating frequency, $f_{warm}$, may drop to 200 Hertz with a normalized $R_{eq(warm)}$ of approximately 0.32 as shown in FIG. 19(*a*). When heating and melting of the transition material progresses to the hot state as described above, hot state operating frequency, $f_{hot}$, may further drop 100 Hertz with a normalized $R_{eq(hot)}$ of approximately 1.0 as shown in FIG. 19(*a*) when the active and passive load circuits are at, or near, resonance.

FIG. 19(*b*) graphically illustrates typical changes in total power supplied to the susceptor vessel and transition material as the heating and melting process progresses through the cold, warm and hot stages for the resistance changes illustrated in FIG. 19(*a*). For example in the cold state, with $f_{cold}$ of 1,000 Hertz, normalized total power may be approximately 0.7, with substantially all power supplied to active coil 44*a*. As the transition material melts in the warm state, power to active coil 44*a* decreases as power to passive coil 44*b* slowly increases for an overall decrease in total supplied power to a minimum of normalized value of 0.37 with an operating frequency of 200 Hertz. At this point power to passive coil 44*b* increases substantially due to increased magnetic coupling with molten transition material in the region surrounded by the passive coil until total supplied normalized power is 1.0 near resonant at $f_{hot}$ (100 Hertz). Hot state operating frequency and power may be near, or at, resonance, for example at points $P_1$, $R_1$ at 100 Hertz in FIG. 19(*b*) and FIG. 19(*a*); or at points $P_2$, $R_2$. Further, near resonance $f_{hot}$ may be lower than resonance frequency such as points $P_3$, $R_3$, in the portion of the total resistance and total power curves shown in dashed lines in FIG. 19(*b*) and FIG. 19(*a*) respectively.

Further processing of molten transition material after the hot stage has been reached may include addition of solid transition material to the molten transition material in the susceptor vessel; solidification of the transition material in the susceptor vessel; or pouring of molten transition material from the susceptor, for example, by bottom pour, vessel tilt pour, pressure pour, or other types of material extraction processes and apparatus.

Monitored electrical parameters of the induction heating and melting system of the present invention can provide input to a control system for determining when changes in output frequency and power levels from the inverter are made. For example initial system resistance $R_{eq}$ of the heating and melting system with substantially non-electrically conductive transition material in the susceptor vessel (cold state) is substantially equal to the relatively high resistance $R_{sv}$ of the susceptor vessel. As the heating process proceeds as described above, system resistance $R_{eq}$ begins to drop as the transition material becomes electrically conductive (warm state). When the control system senses that the drop in system resistance, the control system can output appropriate control signals to the inverter to reduce output frequency as the warm state progresses. During this stage of the process the equivalent resistance $R_{eq}$ continues to decrease as more electromagnetic energy suscepts to the electrically conductive transition material until passive induction coil 44*b* effectively couples with the magnetic field generated by the flow of current in active induction coil 44*a* as graphically illustrated in FIG. 19(*a*) and FIG. 19(*b*).

Figure 20:
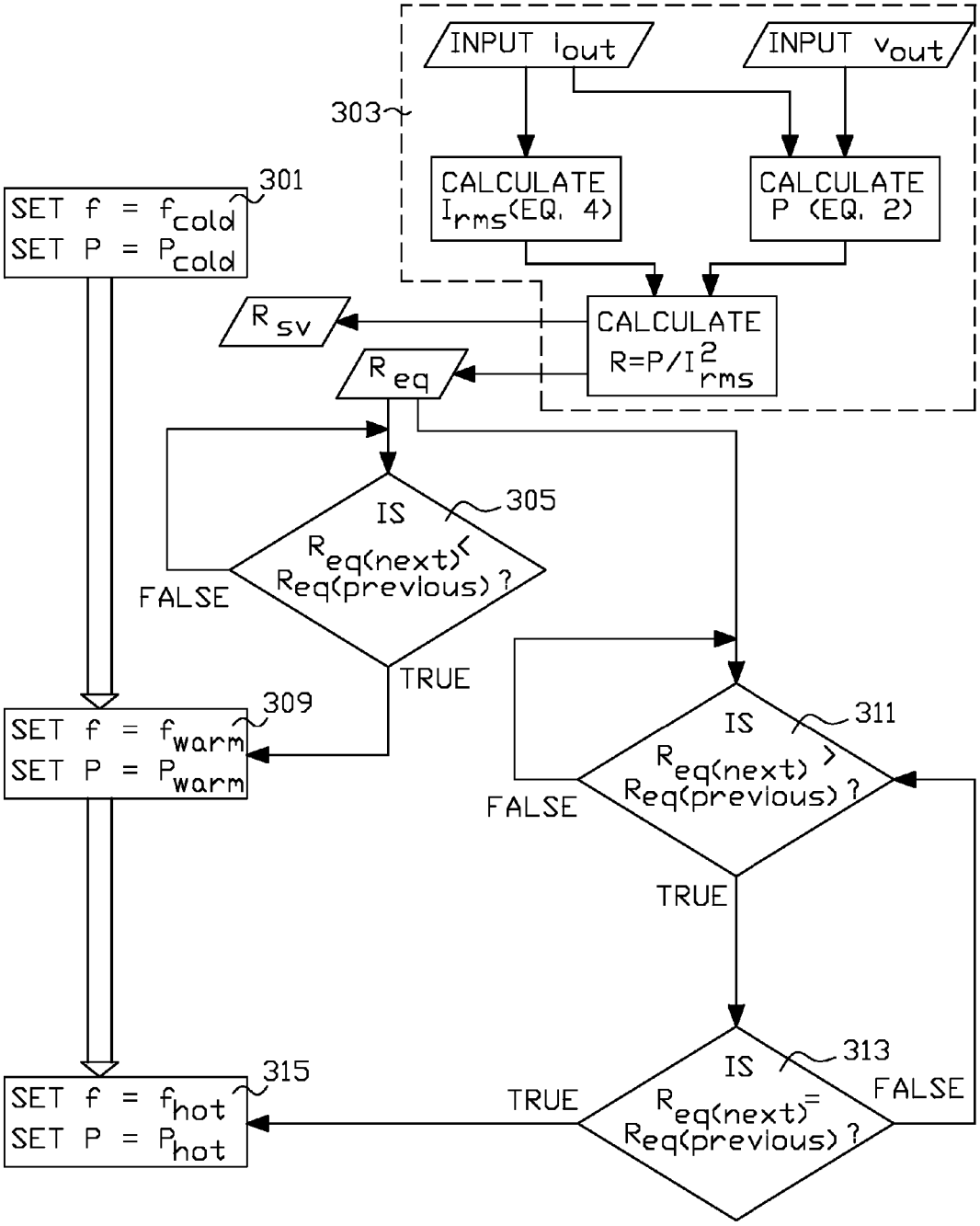
FIG. 20 is a flow chart illustrating one example of the electric induction control system of the present invention.

By way of example and not limitation, a control system for the heating and melting of a transition material in a susceptor vessel may be practice by implementing the simplified control algorithm illustrated in the flow diagram presented in FIG. 20 with suitable computer hardware and software programming of the routines shown in the flow diagram. In FIG.

20 during a batch melting process, after a batch of solid (substantially non-electrically conductive) transition material is placed in the susceptor vessel, routine 301 sets the inverter's output frequency, f, at $f_{cold}$ and the inverter's output power level, P, at $P_{cold}$. Frequency $f_{cold}$ can be determined for a particular susceptor vessel from equation (6) above, with optional allowance for penetration of the magnetic field into the interior of the vessel to inductively heat melting transition material adjacent to the heated wall of the susceptor as described above. $P_{cold}$ can be selected as described above.

Subroutine 303 can be continuously executed to determine instantaneous inverter output power level, P, instantaneous rms load current, $I_{rms}$, and resulting load resistance, R, from input measured inverter output voltage, $v_{out}$, and current, $I_{out}$, as referenced in FIG. 18.

Once frequency $f_{cold}$ and power level $P_{cold}$ are set, subroutine 303 outputs calculated susceptor vessel resistance, $R_{sv}$. As the heating process proceeds, subroutine 303 repeatedly outputs updated calculated equivalent resistance, $R_{eq}$. Routine 305 is repeatedly executed to determine if the next outputted $R_{eq(next)}$ is less than the previous outputted $R_{eq(previous)}$, which indicates that the transition material is melting. When $R_{eq(next)}<R_{eq(previous)}$ is true, routine 309 sets the inverter's output frequency, f, to $f_{warm}$ and the inverter's output power level, P, to $P_{warm}$ for the warm stage of the heating and melting process. As described above, equivalent resistance, $R_{eq}$ will continue to decrease during the warm stage until there is effective magnetic coupling between the active and passive induction coil circuit. Frequency $f_{warm}$ and output power level $P_{warm}$ are selected as described above. Since equivalent resistance $R_{eq}$ continuously decreases during the warm stage, $f_{warm}$ and $P_{warm}$ may be continuously changed during the warm stage to enhance heating of the increasing volume of partially molten transition material in the susceptor vessel.

Subroutine 311 can be repeatedly executed to determine if equivalent resistance $R_{eq}$ has begun to increase in value by comparing a previously calculated value of equivalent resistance $R_{eq(previous)}$ with the next calculated value of equivalent resistance $R_{eq(next)}$. When this state is true, subroutine 313 can be continuously executed to determine if the resonant maximum equivalent resistance $R_{eq}$ (resonance) has been reached by testing for the equality of $R_{eq(previous)}$ and $R_{eq(next)}$. When that state is true, routine 315 sets the inverter's output frequency to $f_{hot}$, at, or near, resonance, and the inverter's output power level $P_{hot}$ to stir and hold the entire molten volume of transition material at a selected temperature in the susceptor vessel until further processing (for example, addition of solid transition material to the vessel; solidification of transition material in the vessel; or extracting the transition material from the vessel with suitable apparatus, such as pouring apparatus) of the molten transition material is performed.

A graphite composition is one suitable, but non-limiting choice for susceptor vessel 42. In other examples of the inventions any suitable susceptor material, such as but not limited to, molybdenum, silicon carbide, stainless steel, and high temperature steel alloys, that is, a steel that has satisfactory mechanical properties under load at temperatures of up to about 540° C., may be used.

In other examples of the invention, the susceptor vessel may be a self-contained vacuum chamber, or a susceptor vessel contained within a vacuum chamber.

Active and passive coil configurations around the susceptor vessel can be varied in arrangement and quantities without deviating from the scope of the invention. For example the active coil may surround approximately the bottom quarter of the susceptor vessel and the passive coil may surround approximately a quarter of the susceptor vessel above the active coil.

It is noted that the foregoing examples have been provided merely for the purpose of explanation and are in no way to be construed as limiting of the present invention. While the invention has been described with reference to various embodiments, it is understood that the words which have been used herein are words of description and illustration, rather than words of limitations. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. The examples of the invention include reference to specific electrical components. One skilled in the art may practice the invention by substituting components that are not necessarily of the same type but will create the desired conditions or accomplish the desired results of the invention. For example, single components may be substituted for multiple components or vice versa. Circuit elements without values indicated in the drawings can be selected in accordance with known circuit design procedures. Those skilled in the art, having the benefit of the teachings of this specification, may effect numerous modifications thereto and changes may be made without departing from the scope of the invention in its aspects.

The invention claimed is:

1. A method of heating and melting a transition material, the method comprising the steps of:

depositing the transition material in a non-electrically conductive state in a susceptor vessel having a lower section surrounded by at least one active induction coil connected to an output of a variable frequency power supply, and an upper section above the lower section surrounded by at least one secondary induction coil connected to at least one resonance capacitor to form a passive coil circuit;

supplying power from the output of the variable frequency power supply to the at least one active induction coil at a start frequency so that a standard depth of penetration is not substantially greater than a wall thickness of the susceptor vessel to electromagnetically heat the susceptor vessel and transition the transition material in the susceptor vessel to an electrically conductive state by conduction heating supplied from the susceptor vessel; and reducing the frequency of the output of the variable frequency power supply from the start frequency to an intermediate frequency responsive to the transition of the transition material in the susceptor vessel from the non-electrically conductive state to the electrically conductive state.

2. The method of claim 1 further comprising the step of further reducing the frequency of the output of the variable frequency power supply from the intermediate frequency when the transition material in the region of the at least one secondary induction coil is in the electrically conductive state to operate the passive coil circuit at or near resonance.

3. The method of claim 2 further comprising the steps of adding an additional transition material in the non-electrically conductive state to the transition material in the electrically conductive state in the susceptor vessel and adjusting the frequency of the output of the variable frequency power supply responsive to the change in resistance of the transition material in the susceptor vessel.

4. The method of claim 2 further comprising the steps of adding an additional transition material in the non-electrically conductive state to the transition material in the electrically conductive state in the susceptor vessel and adjusting the power from the output of the variable frequency power supply responsive to the change in resistance of the transition material in the susceptor vessel.

5. The method of claim 1 further comprising the step of changing the magnitude of the power from the output of the variable frequency power supply responsive to the transition of the transition material in the susceptor vessel from the non-electrically conductive state to the electrically conductive state when the frequency of the output of the variable frequency power supply is the intermediate frequency.

6. The method of claim 1 further comprising the step of containing the susceptor vessel in a vacuum chamber.

7. The method of claim 1 wherein the variable frequency power supply comprises a full-bridge DC to AC inverter having at least one intermediate capacitor connected across a DC input to the full-bridge DC to AC inverter, the at least one intermediate capacitor forming a resonant circuit with an AC load circuit comprising the at least one active induction coil and the passive coil circuit connected to an output of the full-bridge DC to AC inverter when all of the transition material in the susceptor vessel is in the electrically conductive state and the frequency of the output of the variable frequency power supply is selected to operate at or near resonance.

8. A method of heating and melting a transition material, the method comprising the steps of:

depositing the transition material in a non-electrically conductive state in a susceptor vessel lined with a liner material to form a lined susceptor vessel, the lined susceptor vessel having a lower section surrounded by at least one active induction coil connected to an output of a variable frequency power supply, and an upper section above the lower section surrounded by at least one secondary induction coil connected to at least one resonance capacitor to form a passive coil circuit;

supplying power from the output of the variable frequency power supply to the at least one active induction coil at a start frequency so that a standard depth of penetration is not greater than a wall thickness of the lined susceptor vessel to electromagnetically heat the lined susceptor vessel and transition the transition material in the lined susceptor vessel to an electrically conductive state by conduction heating supplied from the lined susceptor vessel;

limiting the supplied power from the output of the variable frequency power source to a maximum of the thermal withstand density of the liner material; and reducing the frequency of the output of the variable frequency power supply from the start frequency to an intermediate frequency responsive to the transition of the transition material in the lined susceptor vessel from the non-electrically conductive state to the electrically conductive state.

9. The method of claim 8 further comprising the step of further reducing the frequency of the output of the variable frequency power supply from the intermediate frequency when the transition material in the region of the at least one secondary induction coil is in the electrically conductive state to operate the passive coil circuit at or near resonance.

10. The method of claim 9 further comprising the steps of adding an additional transition material in the non-electrically conductive state to the transition material in the electrically conductive state in the lined susceptor vessel and adjusting the frequency of the output of the variable frequency power supply responsive to the change in resistance of the transition material in the lined susceptor vessel.

11. The method of claim 9 further comprising the steps of adding an additional transition material in the non-electrically conductive state to the transition material in the electrically conductive state in the lined susceptor vessel and adjusting the power from the output of the variable frequency power supply responsive to the change in resistance of the transition material in the susceptor vessel.

12. The method of claim 8 further comprising the step of changing the magnitude of the power from the output of the variable frequency power supply responsive to the transition of the transition material in the lined susceptor vessel from the non-electrically conductive state to the electrically conductive state when the frequency of the output of the variable frequency power supply is the intermediate frequency.

13. The method of claim 8 further comprising the step of containing the lined susceptor vessel in a vacuum chamber.

14. The method of claim 8 wherein the variable frequency power supply comprises a full-bridge DC to AC inverter having at least one intermediate capacitor connected across a DC input to the full-bridge DC to AC inverter, the at least one intermediate capacitor forming a resonant circuit with an AC load circuit comprising the at least one active induction coil and the passive coil circuit connected to an output of the full-bridge DC to AC inverter when all of the transition material in the lined susceptor vessel is in the electrically conductive state and the frequency of the output of the variable frequency power supply is selected to operate at or near resonance.

15. A method of heating and melting a transition material, the method comprising the steps of:

depositing the transition material in a non-electrically conductive state in a susceptor vessel having a lower section surrounded by at least one active induction coil connected to an output of a variable frequency power supply, and an upper section above the lower section surrounded by at least one secondary induction coil connected to at least one resonance capacitor to form a passive coil circuit;

supplying power from the output of the variable frequency power supply to the at least one active induction coil at a cold frequency, $f_{cold}$, to heat and melt the transition material in the susceptor vessel to an electrically conductive state wherein the cold frequency, $f_{cold}$, is determined from the equation, $$f_{cold} = 2.53 \cdot 10^5 \cdot \frac{\rho_{SV}}{t^2},$$

where $\rho_{sv}$ is the resistivity of the susceptor vessel and t is a wall thickness of the susceptor vessel;

adjusting the cold frequency of the output of the variable frequency power supply from the cold frequency to an intermediate frequency responsive to the transition of the transition material in the susceptor vessel to the electrically conductive state, the intermediate frequency in a range less than the cold frequency; and adjusting the frequency of the output of the variable frequency power supply from the intermediate frequency to a hot frequency, $f_{hot}$, the hot frequency being less than the intermediate frequency and determined from the equation, $$f_{hot} = \frac{1}{2\pi\sqrt{L_{pas} \cdot C_{TUNE}}}$$

where $L_{pas}$ is the inductance of the at least one secondary induction coil and $C_{TUNE}$ is the capacitance of the at least one resonance capacitor when the transition material in the region of the at least one secondary coil is in the electrically conductive state to establish a running electromagnetic wave in the transition material for circulating the transition material from a bottom of the susceptor vessel upwards along an interior wall of the susceptor vessel and then downwards through a central vertical region of the transition material in the susceptor vessel.

16. The method of claim 15 further comprising the step of adding an additional transition material in the non-electrically conductive state to the transition material in the electrically conductive state in the susceptor vessel when the frequency of the output of the variable frequency power supply is the hot frequency.

17. The method of claim 16 further comprising the step of adjusting the frequency of the output of the variable frequency power supply responsive to the change in resistance of the transition material in the susceptor vessel when the additional transition material is added.

18. The method of claim 16 further comprising the step of adjusting a power output of the variable frequency power supply responsive to the change in resistance of the transition material in the susceptor vessel when the additional transition material is added.

19. The method of claim 15 further comprising the step of reducing the cold frequency to no more than 20 percent of the cold frequency $f_{cold}$.

* * * * *